US009170557B2

(12) United States Patent
Watanabe et al.

(10) Patent No.: US 9,170,557 B2
(45) Date of Patent: Oct. 27, 2015

(54) CLEANING BLADE, IMAGE FORMING APPARATUS, AND PROCESS CARTRIDGE

(71) Applicants: Kazuhiko Watanabe, Tokyo (JP); Takaaki Tawada, Kanagawa (JP); Takatsugu Fujishiro, Tokyo (JP); Hisashi Kikuchi, Kanagawa (JP)

(72) Inventors: Kazuhiko Watanabe, Tokyo (JP); Takaaki Tawada, Kanagawa (JP); Takatsugu Fujishiro, Tokyo (JP); Hisashi Kikuchi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/269,347

(22) Filed: May 5, 2014

(65) Prior Publication Data

US 2014/0341629 A1 Nov. 20, 2014

(30) Foreign Application Priority Data

May 17, 2013 (JP) ..... 2013-105344
Jan. 8, 2014 (JP) ..... 2014-001472

(51) Int. Cl.
*G03G 21/00* (2006.01)

(52) U.S. Cl.
CPC ..... *G03G 21/0017* (2013.01)

(58) Field of Classification Search
CPC ..... G03G 21/0017; G03G 9/0827; G03G 15/161; G03G 15/1605; G03G 2215/0174; G03G 2221/1639; G03G 2221/1642; G03G 2221/1672; G03G 9/0821; G03G 21/0011; G03G 15/1615; G03G 2215/0193; G03G 21/105
See application file for complete search history.

(56) References Cited

U.S. PATENT DOCUMENTS

| | | | | |
|---|---|---|---|---|
| 2005/0100375 | A1 | 5/2005 | Naruse et al. | |
| 2005/0254868 | A1 | 11/2005 | Naruse et al. | |
| 2006/0099016 | A1 | 5/2006 | Watanabe et al. | |
| 2006/0285898 | A1 | 12/2006 | Watanabe et al. | |
| 2008/0063448 | A1 | 3/2008 | Hozumi et al. | |
| 2008/0286020 | A1 | 11/2008 | Watanabe et al. | |
| 2009/0123205 | A1 | 5/2009 | Watanabe et al. | |
| 2010/0067945 | A1 | 3/2010 | Hozumi et al. | |
| 2010/0067949 | A1 | 3/2010 | Watanabe et al. | |
| 2011/0229186 | A1 | 9/2011 | Okamoto et al. | |
| 2011/0229188 | A1 | 9/2011 | Watanabe et al. | |
| 2011/0229233 | A1 | 9/2011 | Watanabe et al. | |
| 2014/0193172 | A1* | 7/2014 | Tawada et al. | 399/111 |
| 2014/0205338 | A1* | 7/2014 | Gondoh et al. | 399/350 |

FOREIGN PATENT DOCUMENTS

| | | |
|---|---|---|
| JP | 2007-086202 | 4/2007 |
| JP | 2011-197309 | 10/2011 |

* cited by examiner

*Primary Examiner* — Roy Y Yi
(74) *Attorney, Agent, or Firm* — Harness, Dickey & Pierce

(57) ABSTRACT

A cleaning blade includes a blade member formed of a strip-shaped rubber material and having a leading-edge ridge line portion to contact a moving surface of a cleaning target member and remove adhering matter from the surface of the cleaning target member. The blade member has a Martens hardness of 1.0 N/mm$^2$ or more in a vicinity of the leading-edge ridge line portion measured from an opposing surface of the blade member, the opposing surface including the leading-edge ridge line portion and opposing the cleaning target member, or measured from a leading-edge surface of the blade member, the leading-edge surface including the leading-edge ridge line portion and disposed adjacent to the opposing surface of the blade member.

12 Claims, 14 Drawing Sheets

OUTER CIRCUMFERENCE LENGTH : C1

AREA OF ACTUAL PROJECTED TONER : S

CIRCLE HAVING AREA S

OUTER CIRCUMFERENCE LENGTH : C2

CLEANING BLADE, IMAGE FORMING APPARATUS, AND PROCESS CARTRIDGE

CROSS-REFERENCE TO RELATED APPLICATIONS

This patent application is based on and claims priority pursuant to 35 U.S.C. §119 from Japanese Patent Application No. 2013-105344, filed on May 17, 2013, and 2014-001472, filed on Jan. 8, 2014, both in the Japan Patent Office, which are hereby incorporated by reference herein in its entirety.

BACKGROUND

1. Technical Field

Exemplary embodiments of the present disclosure generally relate to a cleaning blade, an electrophotographic image forming apparatus employing the cleaning blade, and a process cartridge detachably attached with respect to the image forming apparatus.

2. Related Art

In conventional electrophotographic image forming apparatuses, after a toner image is transferred to an intermediate transfer body or a transfer sheet, an unnecessary transfer residue toner adhering to a surface of an image carrier such as a photoreceptor serving as a cleaning target member is removed by a cleaning device serving as a cleaning mechanism. A configuration of the cleaning device is typically simple and from a point of good cleaning performance, employing a strip shaped cleaning blade is well known. The cleaning blade is configured of a blade member formed of an elastic member such as a polyurethane rubber. A base end of the blade member is supported by a supporting member and a leading-edge ridge line portion contacts the surface of the image carrier. The transfer residue toner on the image carrier is removed by stopping and scraping off with the blade member.

In conventional cleaning blades, the blade member having a single layer configuration of a low hardness polyurethane rubber is widely employed.

In JP-2007-086202-A and JP-2011-197309-A, a cleaning blade employing a blade member having a laminated structure including an edge layer having a leading-edge ridge line portion that contacts the image carrier formed of a comparatively high hardness rubber material and a backup layer formed of a rubber material having a hardness lower than the edge layer is disclosed.

In recent years, in addition to high reliability and high operational life of an image forming apparatus, energy saving in the image forming apparatus is becoming more and more important due to heightened environmental awareness. Energy saving in a fixing process of the image forming apparatus that consumes the most energy in the image forming apparatus is an important challenge for energy saving, and development of energy saving technology of the fixing device and development of a low temperature fixing toner are being actively conducted. In the low temperature fixing toner, a toner needs to gum/soften at a further low temperature. In accordance with making the toner gum/soften at the further low temperature, a glass transition temperature declines. For example, the toner having the glass transition temperature (Tg) in a range from 40° C. to 60° C. has been developed.

In continuous action of image formation with the image forming apparatus, an internal temperature of the image forming apparatus rises. In a temperature range from 10° C. to 35° C. conceivable in a typical office environment, the internal temperature of the image forming apparatus may rise to around a glass transition temperature or more of a low temperature fixing toner. For example, in a middle speed apparatus, an internal temperature of the middle speed apparatus may rise to around a glass transition temperature of 60° C. of a low temperature fixing toner. In a high speed apparatus, there is a case in which an internal temperature of the high speed apparatus rises even higher than around a glass transition temperature of a low temperature fixing toner. In addition, in a cleaning blade system, a friction heat is generated by a sliding friction force between the image carrier and the blade member at a contact portion, and a temperature of the leading-edge ridge line portion of the blade member rises even higher than the internal temperature.

In the cleaning blade system, the leading-edge ridge line portion of the blade member contacts the surface of the image carrier that moves, and the leading-edge ridge line portion stops and removes the transfer residue toner. However, the leading-edge ridge line portion of the blade member deforms and is drawn towards the moving direction of the image carrier due to the sliding friction force between the image carrier and the blade member. Accordingly, a portion of the stopped transfer residue toner slips through the leading-edge ridge line portion little by little. The transfer residue toner is pressed against the image carrier when the transfer residue toner slips through the leading-edge ridge line portion little by little.

In a case of employing the low temperature fixing toner, the low temperature fixing toner adheres to the image carrier by easily gumming/softening due to the temperature rise of the leading-edge ridge line portion and a pressing force when the low temperature fixing toner slips through the deformed leading-edge ridge line portion little by little. The transfer residue toner adhering to the surface of the image carrier becomes a film over time and filming is generated on the surface of the image carrier. When filming is generated, problems such as image density unevenness, cleaning failure, and charging failure are generated.

JP-2007-086202-A and JP-2011-197309-A describe suppression of deformation of the leading-edge ridge line portion of the edge layer in the blade member formed of the comparatively high hardness rubber material, and slipping through of the transfer residue toner through the leading-edge ridge line portion becoming difficult. Accordingly, the blade member of JP-2007-086202-A and JP-2011-197309-A are thought to be advantageous in suppressing the generation of filming by the low temperature fixing toner. However, conditions of the comparatively high hardness rubber material are not considered for favorably suppressing the generation of filming by the low temperature fixing toner.

In JP-2007-086202-A, a hardness of the edge layer including a vicinity of the leading-edge ridge line portion is determined as a rubber hardness of 75 to 90 measured with a JIS-A measurement method commonly employed to represent hardness of a rubber material. However, in a blade member configured of a comparatively thin edge layer and the backup layer, when a rubber hardness of the comparatively thin edge layer is measured from a surface perpendicular to the laminated direction of the backup layer with the JIS-A measurement method, a measured value of the rubber hardness of the comparatively thin edge layer includes influence of the backup layer. Accordingly, employing a rubber hardness measured with the JIS-A measurement method as an index of a hardness of the leading-edge ridge line portion of the blade member for suppressing filming by the low temperature fixing toner may lead to, depending on position of hardness measurement, not obtaining sufficient suppressing effect by the leading-edge ridge line portion of the blade member.

SUMMARY

In view of the foregoing, in an aspect of this disclosure, there is provided a novel cleaning blade including a blade member formed of a strip-shaped rubber material and having a leading-edge ridge line portion to contact a moving surface of a cleaning target member and remove adhering matter from the surface of the cleaning target member. The blade member has a Martens hardness of 1.0 N/mm$^2$ or more in a vicinity of the leading-edge ridge line portion measured from an opposing surface of the blade member, the opposing surface including the leading-edge ridge line portion and opposing the cleaning target member, or measured from a leading-edge surface of the blade member, the leading-edge surface including the leading-edge ridge line portion and disposed adjacent to the opposing surface of the blade member.

The aforementioned and other aspects, features, and advantages will be more fully apparent from the following detailed description of illustrative embodiments, the accompanying drawings, and associated claims.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
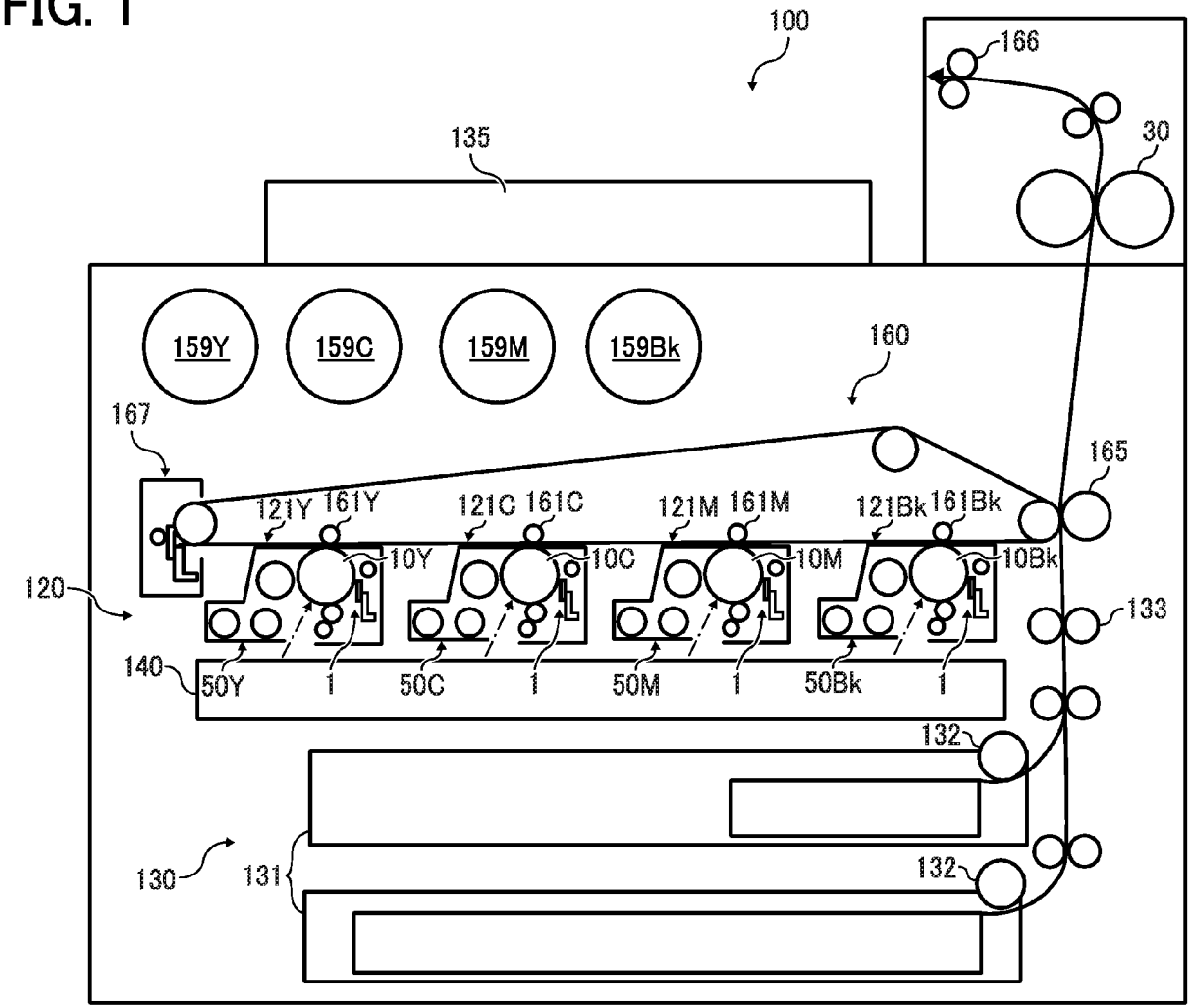
FIG. 1 is a schematic view of a configuration of a printer according to an embodiment of the present invention.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION

Hereinafter, exemplary embodiments of the present invention are described in detail with reference to the drawings. However, the present invention is not limited to the exemplary embodiments described below, but can be modified and improved within the scope of the present invention.

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

In view of the foregoing, in an aspect of this disclosure, there is provided a novel cleaning blade that suppresses filming on a surface of a cleaning target member, an image forming apparatus, and a process cartridge while saving energy.

The following is a detailed description of an example of an electrophotographic printer (hereinafter simply referred to as printer) serving as the image forming apparatus according to an embodiment of the present invention. Referring now to the drawings, a basic configuration of the printer according to an embodiment of the present invention is described in detail below.

FIG. 1 is a schematic view of a configuration of the printer 100 according to an embodiment of the present invention. The printer 100 forms full color images. The printer 100 is roughly configured of an image forming unit 120, an intermediate transfer device 160, and a sheet feed unit 130. In the following description, notation of Y, C, M, and Bk represent a member for yellow, a member for cyan, a member for magenta, and a member for black, respectively.

The image forming unit 120 includes process cartridges 121Y, 121C, 121M, and 121Bk for yellow toner, cyan toner, magenta toner, and black toner, respectively. The process cartridges 121Y, 121C, 121M, and 121Bk are roughly disposed in a line in a horizontal direction. Each of the process cartridges 121Y, 121C, 121M, and 121Bk as a unit is detachably attached with respect to the printer 100.

The intermediate transfer device 160 includes an intermediate transfer belt 162 formed into an endless loop stretched around a plurality of supporting rollers; primary transfer rollers 161Y, 161C, 161M, and 161Bk; and a secondary transfer roller 165. The intermediate transfer belt 162 is disposed above each of the process cartridges 121Y, 121C, 121M, and 121Bk along a direction of movement of a surface of each drum shaped photoreceptors 10Y, 10C, 10M, and 10Bk provided in each of the process cartridges 121Y, 121C, 121M, and 121Bk, respectively. Each of the drum shaped photoreceptors 10Y, 10C, 10M, and 10Bk serve as an electrostatic latent image carrier in which the surface moves. A movement of a surface of the intermediate transfer belt 162 is synchronized with the movement of the surface of each of the drum shaped photoreceptors 10Y, 10C, 10M, and 10Bk. Each of the primary transfer rollers 161Y, 161C, 161M, and 161Bk is disposed along an inner circumferential surface of the intermediate transfer belt 162. Due to the primary transfer rollers 161Y, 161C, 161M, and 161Bk, the surface of the intermediate transfer belt 162 contacts the surface of each of the drum shaped photoreceptors 10Y, 10C, 10M, and 10Bk at low pressure.

A configuration and action of forming a toner image on each of the drum shaped photoreceptors 10Y, 10C, 10M, and 10Bk, and transferring each of the toner images to the intermediate transfer belt 162 is essentially the same for each of the process cartridges 121Y, 121C, 121M, and 121Bk. However, the primary transfer rollers 161Y, 161C, and 161M corresponding to the three process cartridges 121Y, 121C, and 121M for color include a swinging mechanism not shown in FIG. 1 for swinging the primary transfer rollers 161Y, 161C, and 161M up and down. The swinging mechanism operates so that each of the drum shaped photoreceptors 10Y, 10C, and 10M does not contact the intermediate transfer belt 162 when color images are not formed. An intermediate transfer belt cleaning device 167 is provided, with respect to a direction of movement of the surface of the intermediate transfer belt 162, at a downstream side of the secondary transfer roller 165 of the intermediate transfer belt 162 and at an upstream side of the process cartridge 121Y. The intermediate transfer belt cleaning device 167 removes adhering matter such as a residue toner after secondary transfer on the intermediate transfer belt 162.

Toner cartridges 159Y, 159C, 159M, and 159Bk corresponding to each of the process cartridges 121Y, 121C, 121M, and 121Bk, respectively, are roughly disposed in a line in a horizontal direction above the intermediate transfer device 160. An exposure device 140 which irradiates a laser light on the charged surface of each of the drum shaped photoreceptors 10Y, 10C, 10M, and 10Bk to form an electrostatic latent image on the surface of each of the drum shaped photoreceptors 10Y, 10C, 10M, and 10Bk is disposed below the process cartridges 121Y, 121C, 121M, and 121Bk.

The sheet feed unit 130 is disposed below the exposure device 140. The sheet feed unit 130 includes a sheet feed cassette 131 storing a transfer sheet serving as a recording medium, and a sheet feed roller 132. The transfer sheet is fed to a secondary transfer nip between the intermediate transfer belt 162 and the secondary transfer roller 165 at a predetermined timing via a pair of registration rollers 133.

A fixing device 30 is disposed at a downstream side of the secondary transfer nip with respect to a direction of conveyance of the transfer sheet. An ejected sheet storage 135 for storing the transfer sheet ejected from an ejection roller 166 is disposed at a downstream side of the fixing device 30 with respect to the direction of conveyance of the transfer sheet.

Figure 2:
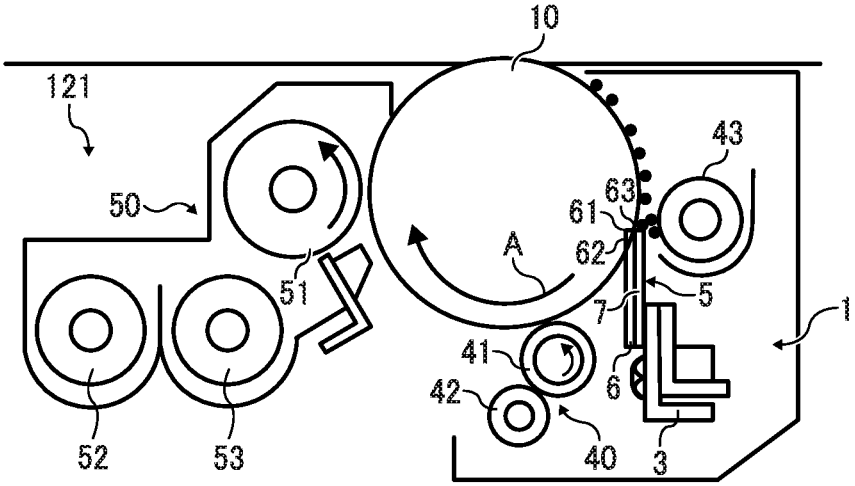
FIG. 2 is a schematic view of an example of a configuration of a process cartridge provided in the printer.

FIG. 2 is a schematic view of an example of a configuration of each of the process cartridges 121Y, 121C, 121M, and 121Bk according to an embodiment of the present invention provided in the printer 100. In the following description, the notations of Y, C, M, and Bk representing members for respective colors are omitted since the configuration of each of the process cartridges 121Y, 121C, 121M, and 121Bk being substantially the same. Referring now to FIG. 2, the configuration and action of the process cartridge 121 is described in detail below.

The process cartridge 121 includes the drum shaped photoreceptor 10, a cleaning device 1 disposed around the drum shaped photoreceptor 10, a charger 40, and a developing member 50.

The cleaning device 1 includes a strip shaped elastic member serving as a cleaning blade 5 having a long side in the direction of a rotation axis of the drum shaped photoreceptor 10. A leading-edge ridge line portion 61 (hereinafter referred to as edge portion 61) serving as an edge ridge line extending perpendicular to the direction of rotation of the drum shaped photoreceptor 10 is pressed against the surface of the drum shaped photoreceptor 10. Accordingly, unnecessary adhering matter such as the residue toner after transfer on the surface of the drum shaped photoreceptor 10 is separated and removed. The adhering matter such as the removed residue toner is ejected outside the cleaning device 1 by an ejection screw 43.

The charger 40 is mainly configured of a charging roller 41 disposed opposite the drum shaped photoreceptor 10, and a charging roller cleaner 42 that contacts and rotates with the charging roller 41.

The developing member 50 (i.e., a developing device) supplies toner to the surface of the drum shaped photoreceptor 10 and makes the electrostatic latent image on the surface of the drum shaped photoreceptor 10 visible. The developing member 50 includes a developing roller 51 serving as a developer carrier carrying developer (i.e., carriers and toner) on a surface of the developer carrier. The developing member 50 mainly includes the developing roller 51, an agitating screw 52 that conveys and agitates the developer stored in a developer container, and a supplying screw 53 that conveys and supplies the agitated developer to the developing roller 51.

The four process cartridges 121Y, 121C, 121M, and 121Bk have the above-described configuration of the process cartridge 121 and each may be independently detached and replaced by a serviceman or a user. The drum shaped photoreceptor 10, the charger 40, the developing member 50, and the cleaning device 1 of the process cartridge 121 may be independently replaced with a new drum shaped photoreceptor, a new charger, a new developing member, and a new cleaning device when the process cartridge 121 is detached from the printer 100. The process cartridge 121 may also include a waste toner tank to collect the residue toner after transfer collected by the cleaning device 1. In a case of the process cartridge 121 having the waste toner tank, a configuration of being able to independently detach and change the waste toner tank enhances convenience.

Next is a description of the action of the printer 100.

The printer 100 receives a print command from an external device such as a personal computer or an operation panel not shown in FIG. 1. The drum shaped photoreceptor 10 of each color moves in a direction (direction of rotation) of an arrow shown in FIG. 2, and the surface of the drum shaped photoreceptor 10 of each color is uniformly charged to a predetermined polarity by the charging roller 41 of the charger 40 of each color. With respect to the surface of the drum shaped photoreceptor 10 of each color after charging, for example, an optically modulated laser beam light for each color corresponding to input color image data is irradiated by the exposure device 140. Accordingly, the electrostatic latent image for each color is formed on the surface of the drum shaped photoreceptor 10 of each color. With respect to the electrostatic latent image of each color, the developing roller 51 of the developing member 50 of each color supplies the developer of each color. The electrostatic latent image of each color is developed with the supplied developer of each color and is made visible. Accordingly, the toner image of each color is obtained.

Next, a transfer voltage having an opposite polarity to the toner image is applied to the primary transfer roller 161 of each color and a primary transfer electric field is formed between the drum shaped photoreceptor 10 of each color and the primary transfer roller 161 of each color sandwiching the intermediate transfer belt 162. At the same time, a primary transfer nip for each color is formed between the intermediate transfer belt 162 and the drum shaped photoreceptor 10 of each color by contacting the primary transfer roller 161 of each color to the intermediate transfer belt 162 at low pressure. Accordingly, the toner image of each color on the surface of the drum shaped photoreceptor 10 of each color is efficiently transferred in a primary transfer to the intermediate transfer belt 162. The toner image of each color formed on the surface of the drum shaped photoreceptor 10 of each color is transferred onto the intermediate transfer belt 162 superimposed one on another to form a composite toner image of the four colors.

With respect to the composite toner image of the four colors formed on the intermediate transfer belt 162 in the primary transfer, the transfer sheet stored in the sheet feed cassette 131 is conveyed via the sheet feed roller 132 and the pair of registration rollers 133 and fed by the pair of registration rollers 133 at the predetermined timing to the secondary transfer nip. Then, a transfer voltage having an opposite polarity to the composite toner image of the four colors is applied to the secondary transfer roller 165 and a secondary transfer electric field is formed between the intermediate transfer belt 162 and the secondary transfer roller 165 sandwiching the transfer sheet. Accordingly, the composite toner image of the four colors is transferred onto the transfer sheet. The transfer sheet having the composite toner image of the four colors is conveyed to the fixing device 30, and heat and pressure are applied to fix the composite toner image of the four colors onto the transfer sheet. The transfer sheet having the fixed composite toner image of the four colors is ejected by the ejection roller 166 and placed in the ejected sheet storage 135. The residue toner after transfer remaining on the drum shaped photoreceptor 10 of each color after the primary transfer is scraped and removed by the cleaning blade 5 of the cleaning device 1 of each color.

Next is a description of the cleaning blade 5 of the cleaning device 1 of each color serving as a characteristic of the printer 100.

Figure 14A:
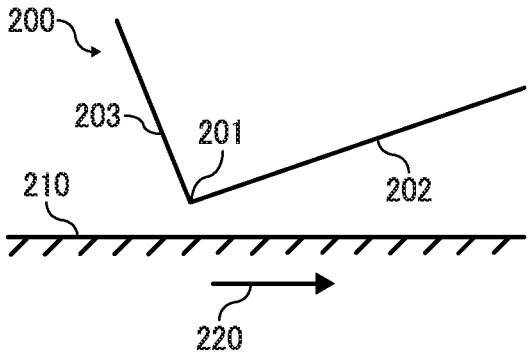
FIG. 14A RELATED ART
FIG. 14A is an enlarged view of an edge portion of a conventional cleaning blade in a state of the edge portion of the conventional cleaning blade not contacting a surface of a photoreceptor.
Figure 14B:
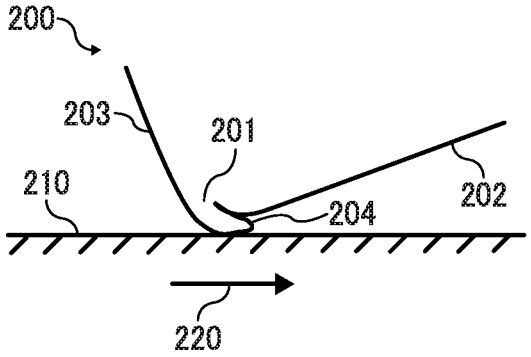
FIG. 14B RELATED ART
FIG. 14B is an enlarged view of the edge portion of the conventional cleaning blade in a state of the edge portion of the conventional cleaning blade contacting the surface of the photoreceptor.

First, problems of a conventional cleaning blade are described below. FIG. 14A and FIG. 14B are enlarged views of an edge portion 201 of the conventional cleaning blade 200. The conventional cleaning blade 200 has a configuration of a single layer formed of, for example, a low hardness polyurethane rubber. A Martens hardness at a vicinity of the edge portion 201 including the edge portion 201 is approximately 0.7 $N/mm^2$.

FIG. 14A is a schematic view of a state of the edge portion 201 of the conventional cleaning blade 200 not contacting a surface of a photoreceptor 210. The conventional cleaning blade 200 having a strip shape includes the edge portion 201 having a right angle shape between an adjacent opposing surface 202 and an adjacent leading-edge surface 203. The opposing surface 202 is disposed opposite the surface of the photoreceptor 210.

FIG. 14B is a schematic view of a state of the edge portion 201 of the conventional cleaning blade 200 contacting the surface of the photoreceptor 210. The surface of the photoreceptor 210 moves in a moving direction indicated by arrow 220 in FIG. 14B. The leading-edge surface 203 forming the edge portion 201 of the conventional cleaning blade 200 is drawn into a downstream side of the moving direction 220 according to the movement of the surface of the photoreceptor 210. Due to the leading-edge surface 203 being drawn into a downstream side of the moving direction 220, the edge portion 201 significantly deforms and a wedge shape portion 204 is formed at the edge portion 201. The wedge shape portion 204 contacts the surface of the photoreceptor 210 and relatively slides according to the movement of the surface of the photoreceptor 210. The opposing surface 202 does not contact the surface of the photoreceptor 210 when the wedge shape portion 204 relatively slides.

When the conventional cleaning blade 200 contacts the surface of the photoreceptor 210 in the above-described state of FIG. 14B, a contact surface area between the conventional cleaning blade 200 and the surface of the photoreceptor 210 is enlarged and a contact pressure does not increase. Thus, a residue toner on the surface of the photoreceptor 210 may slip through the conventional cleaning blade 200 and cleaning performance of removing the residue toner may decline. The residue toner is pressed against the conventional cleaning blade 200 when the residue toner slips through the edge portion 201.

It is to be noted that an internal temperature of the printer 100 may rise to around a glass transition temperature or more of a low temperature fixing toner due to continuous image forming action. For example, in a middle speed apparatus having a linear velocity in a range from approximately 140 m/sec to approximately 260 m/sec, an internal temperature of the middle speed apparatus may rise to 60° C. that is around a glass transition temperature of a low temperature fixing toner. In a high speed apparatus having a linear velocity in a range from approximately 350 mm/sec to approximately 650 mm/sec, there is a case in which an internal temperature of the high speed apparatus rises even higher than around a glass transition temperature of a low temperature fixing toner. Furthermore, a temperature of the edge portion 201 of the conventional cleaning blade 200 rises even higher than an internal temperature of an apparatus due to a generation of friction heat by a sliding friction force at a contact portion of the surface of the photoreceptor 210 and the conventional cleaning blade 200.

When a low temperature fixing toner having a glass transition temperature Tg, for example, in a range from 40° C. to 60° C. slips through the deformed edge portion 201, the low temperature fixing toner easily gums/softens and adheres to the surface of the photoreceptor 210 due to a rise of the temperature of the edge portion 201 and a pressing force. The residue toner adhering to the surface of the photoreceptor 210 becomes a film over time and filming is generated on the surface of the photoreceptor 210. When filming is generated, problems such as image density unevenness, cleaning failure, and charging failure are generated.

Figure 3:
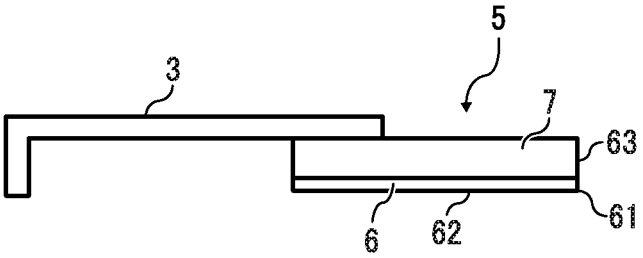
FIG. 3 is a cross sectional view of an example of a cleaning blade according to an embodiment of the present invention.

FIG. 3 is a cross sectional view of an example of the cleaning blade 5 according to an embodiment of the present invention. The cleaning blade 5 is a strip-shaped blade member. The cleaning blade 5 is held at one side surface of a blade holder 3. The cleaning blade 5 shown in FIG. 3 has a laminated structure including an edge layer 6 having the edge portion 61 serving as the edge ridge line extending perpendicular to the direction of rotation of the drum shaped photoreceptor 10, and a backup layer 7 laminated at a back surface of the edge layer 6. The edge portion 61 contacts the surface of the drum shaped photoreceptor 10 and removes unnecessary adhering matter such as the residue toner after transfer on the surface of the drum shaped photoreceptor 10.

Figure 4A:
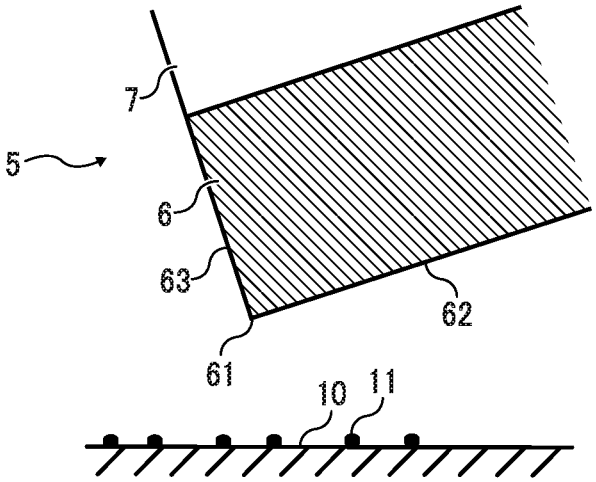
FIG. 4A is an enlarged view of an edge portion of the cleaning blade in FIG. 3 in a state of the edge portion of the cleaning blade not contacting a surface of a drum shaped photoreceptor.
Figure 4B:
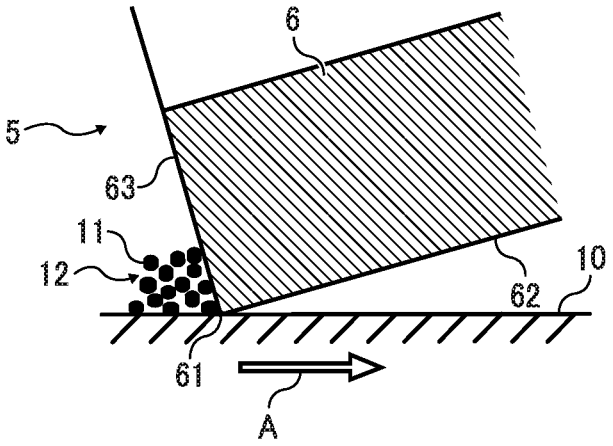
FIG. 4B is an enlarged view of the edge portion of the cleaning blade in FIG. 3 in a state of the edge portion of the cleaning blade contacting the surface of the drum shaped photoreceptor.

FIG. 4A and FIG. 4B is an enlarged view of the edge portion 61 of the cleaning blade 5 in FIG. 3. The cleaning blade 5 employed in the printer 100 has a Martens hardness of 1.0 N/mm$^2$ or more at a vicinity of the edge portion 61 including the edge portion 61.

FIG. 4A is a schematic view of a state of the edge portion 61 of the cleaning blade 5 not contacting the surface of the drum shaped photoreceptor 10. The cleaning blade 5 having the strip shape includes the edge portion 61 having a right angle shape between an adjacent opposing surface 62 and an adjacent leading-edge surface 63. The opposing surface 62 is disposed opposite the surface of the drum shaped photoreceptor 10.

FIG. 4B is a schematic view of a state of the edge portion 61 of the cleaning blade 5 contacting the surface of the drum shaped photoreceptor 10. By making the cleaning blade 5 have the Martens hardness of 1.0 N/mm$^2$ or more at the vicinity of the edge portion 61 including the edge portion 61 that is high hardness, suppression of the leading-edge surface 63 being drawn into a downstream side of the moving direction A according to the movement of the surface of the drum shaped photoreceptor 10 is obtained. A state of smaller deformation of the edge portion 61 is obtained compared to the conventional cleaning blade 200. Accordingly, slipping through of a residue toner 11 is suppressed. Thus, a generation of filming on the surface of the drum shaped photoreceptor 10 is suppressed and a generation of cleaning failure is suppressed.

Figure 18A:
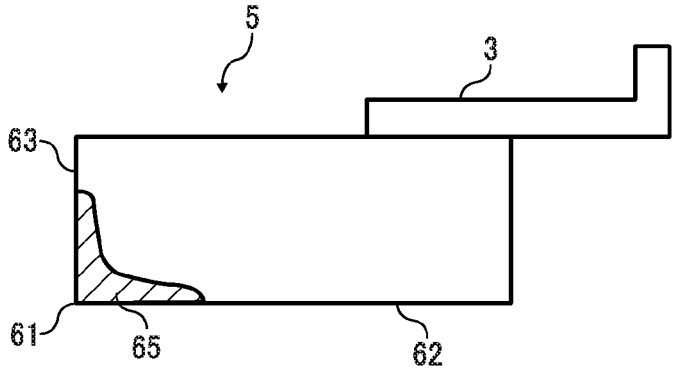
FIG. 18A, FIG. 18B, FIG. 18C, FIG. 18D, FIG. 18E, and FIG. 18F are schematic views of the cleaning blade according to an embodiment of the present invention including an impregnated portion of an ultraviolet ray hardening resin impregnated to a portion including the edge portion.
Figure 18B:
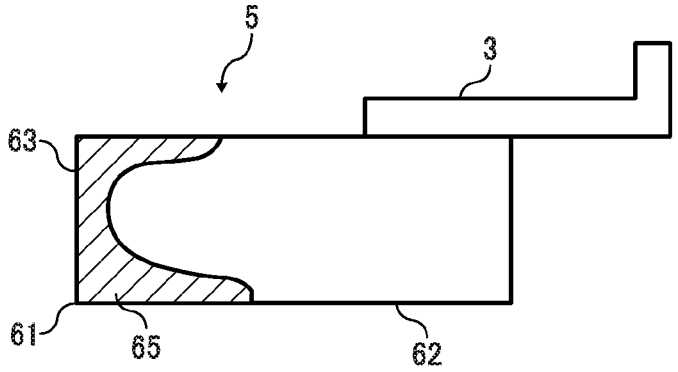
Figure 18C:
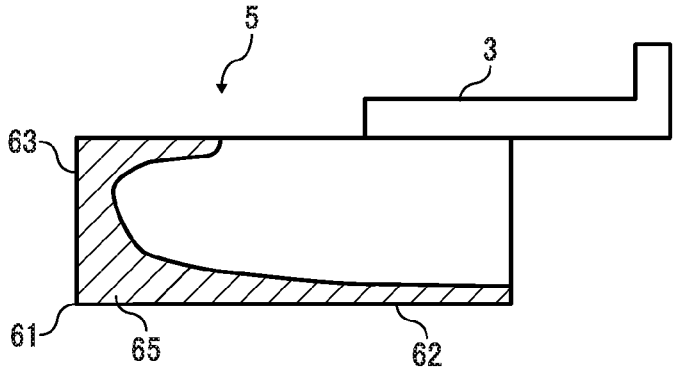
Figure 18D:
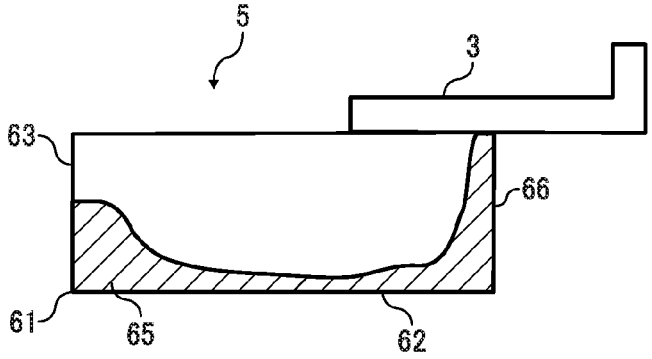
Figure 18E:
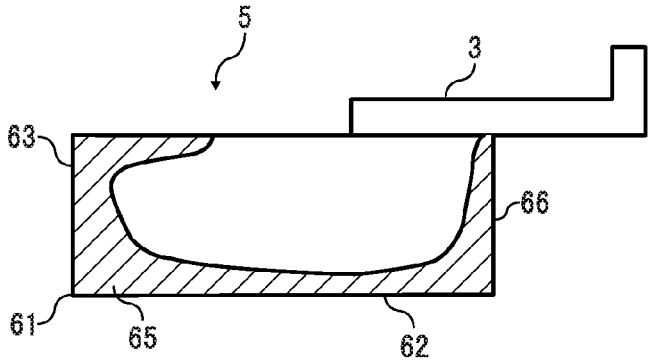
Figure 18F:
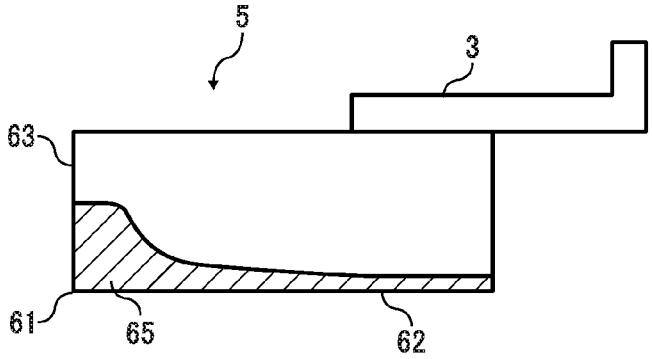

As shown in FIG. 18A, FIG. 18B, FIG. 18C, FIG. 18D, FIG. 18E, and FIG. 18F, the cleaning blade 5 may have a single layer structure formed of a low hardness polyurethane rubber including an impregnated portion 65 of an ultraviolet ray hardening resin having the edge portion 61, and a Martens hardness at a vicinity of the edge portion 61 including the edge portion 61 of 1.0 N/mm$^2$ or more. As shown in FIG. 18A, the impregnated portion 65 may be provided at the vicinity of the edge portion 61 including the edge portion 61 only or, as shown in FIG. 18B, the impregnated portion 65 may be provided at the vicinity of the edge portion 61 including the edge portion 61 and the leading-edge surface 63. As shown in FIG. 18C, the impregnated portion 65 may be provided at the leading-edge surface 63 and the opposing surface 62. As shown in FIG. 18D, the impregnated portion 65 may be provided at the vicinity of the edge portion 61 including the edge portion 61, the opposing surface 62, and an end surface 66. As shown in FIG. 18E, the impregnated portion 65 may be provided at the leading-edge surface 63, the opposing surface 62, and the end surface 66. As shown in FIG. 18F, the impregnated portion 65 may be provided at the vicinity of the edge portion 61 including the edge portion 61 and the opposing surface 62.

Impregnation of the ultraviolet ray hardening resin to the cleaning blade 5 having elasticity (hereinafter referred to as elastic cleaning blade 5) may be conducted by brush coating, spray coating, and dip coating. The ultraviolet ray hardening resin for impregnation is a material having a Martens hardness of 250 N/mm$^2$ to 500N/mm2 and an elastic power of 75% or less, preferably 50% to 75%. Accordingly, deformation of the edge portion 61 of the elastic cleaning blade 5 contacting the surface of the drum shaped photoreceptor 10 in the direction of movement of the surface of the drum shaped photoreceptor 10 is suppressed. Further, even when an inner portion of the elastic cleaning blade 5 is exposed due to wear of the surface of the elastic cleaning blade 5 over time, deformation of the elastic cleaning blade 5 is also suppressed due to an effect of impregnation into the inner portion.

Figure 19:
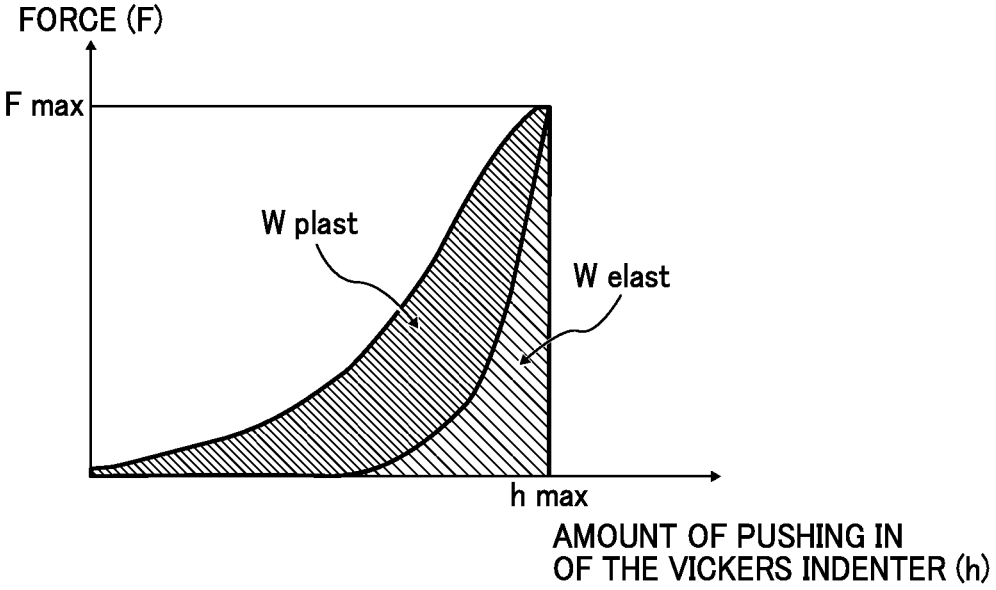
FIG. 19 is a graph showing integrated stress at pushing in the Vickers indenter as Wplast and integrated stress at removing a test load as Welast.

The Martens hardness of the ultraviolet ray hardening resin is measured by employing a microhardness measurement instrument HM-2000 (from Fischer Instrumentation Ltd.). More specifically, the ultraviolet ray hardening resin is applied onto a glass plate to a layer thickness of 20 μm and is pushed with a Vickers indenter at a force of 9.8 mN for 30 seconds, maintained for 5 seconds, and pull-out is measured over 30 seconds at the force of 9.8 mN. The elastic power is a property value determined, as follows, from integrated stress when measuring the Martens hardness. When integrated stress at pushing in the Vickers indenter is Wplast and when integrated stress at removing a test load is Welast, the elastic power is the property value defined by a formula Welast/Wplast×100%. For reference, see FIG. 19. The higher the elastic power is, a hysteresis loss (plastic deformation) is small. In other words, rubber properties of the ultraviolet ray hardening resin are high. When the elastic power is too low, the ultraviolet ray hardening resin is closer to a state of glass rather than rubber.

It is to be noted that the above-described Martens hardness at the vicinity of the edge portion 61 including the edge portion 61 of FIG. 18A, FIG. 18B, FIG. 18C, FIG. 18D, FIG. 18E, and FIG. 18F is the Martens hardness of the elastic cleaning blade 5 in a state of having the ultraviolet ray hardening resin impregnated, and is different from the above-described Martens hardness of the ultraviolet ray hardening resin.

The ultraviolet ray hardening resin for impregnation preferably is a material having high hardness and high elasticity. The material is preferably methacrylate or acrylate including a tricyclodecane or adamantane skeleton. Methacrylate or acrylate including the tricyclodecane or adamantane skeleton are preferable due to being able to compensate for a lack of crosslinking points when functional groups are few because of a particular structure of the tricyclodecane or adamantane skeleton. Specific examples of methacrylate or acrylate including the tricyclodecane or adamantane skeleton include, but are not limited to, tricyclodecane dimethanol diacrylate; 1,3-adamantane dimethanol diacrylate; 1,3-adamantane dimethanol dimethacrylate; 1,3,5-adamantane trimethanol triacrylate; and 1,3,5-adamantane trimethanol trimethacrylate. Two or more of the above-described methacrylate or acrylate including the tricyclodecane or adamantane skeleton may be used in combination.

The number of functional groups in methacrylate or acrylate including the tricyclodecane or adamantane skeleton is preferably 1 to 6, more preferably 2 to 4. When the number of functional groups is only one, crosslinked structure is weak. When the number of functional groups is 5 or more, a possibility of steric hindrance may occur. Thus, it is preferable to mix methacrylate or acrylate having a different number of functional groups. A molecular weight of functional groups in methacrylate or acrylate including the tricyclodecane or adamantane skeleton is preferably 500 or less. When the molecular weight of the functional groups in methacrylate or acrylate including the tricyclodecane or adamantane skeleton is 500 or more, molecular size becomes large and impregnation into the elastic cleaning blade 5 becomes difficult and obtaining high hardness becomes difficult.

An acrylate monomer having a molecular weight of 100 to 1500 may be mixed to an impregnation coating liquid for impregnating the ultraviolet ray hardening resin to the elastic cleaning blade 5 by brush coating, spray coating, and dip coating. Specific examples of the acrylate monomer include, but are not limited to, dipentaerythritol hexaacrylate; pentaerythritol tetraacrylate; pentaerythritol triacrylate; pentaerythritol ethoxy tetraacrylate; trimethylolpropane triacrylate; trimethylolpropane ethoxy triacrylate; 1,6-hexanediol diacrylate; ethoxylated bisphenolA diacrylate; propoxylated ethoxylated bisphenolA diacrylate; 1,4-butanediol diacrylate; 1,5-pentanediol diacrylate; 1,6-hexanediol diacrylate; 1,7-heptanediol diacrylate; 1,8-octanediol diacrylate; 1,9-nonanediol diacrylate; 1,10-decanediol diacrylate; 1,11-undecanediol diacrylate; 1,18-octadecanediol diacrylate; glycerin propoxy triacrylate; dipropylene glycol diacrylate; tripropylene glycol diacrylate; propyleneoxide (PO)-modified neopentyl glycol diacrylate; polyethyleneglycol (PEG) 600 diacrylate; PEG 400 diacrylate; PEG 200 diacrylate; neopentylglycol hydroxypivalate diacrylate; octyl/decyl acrylate; isobornyl acrylate; ethoxylated phenyl acrylate; and 9,9-bis[4-(2-acryloyloxyethoxy)phenyl]fluorene. One or two or more of the above-described acrylate monomer may be used in combination.

A diluent of the impregnation coating liquid preferably has a low boiling point and the ultraviolet ray hardening resin is soluble in the diluent.

Specifically, 160° C. or less, more preferably 100° C. or less. Specific examples of the diluent include, but are not limited to, hydrocarbon based solvents such as toluene and xylene; ester based organic solvents such as ethyl acetate, n-butyl acetate, methyl cellosolve acetate, and propylene glycol monomethyl ether acetate; ketone based organic solvents such as methyl ethyl ketone, methyl isobutyl ketone, diisobutyl ketone, cyclohexanone, and cyclopentanone; ether based organic solvents such as ethylene glycol monomethyl ether, ethylene glycol monoethyl ether, and propylene glycol monomethyl ether; and alcohol based organic solvents such as ethanol, propanol, 1-butanol, isopropyl alcohol, and isobutyl alcohol.

The above-described diluent has an effect of accelerating impregnation at coating. On the other hand, the above-described diluent may degrade physical properties of a rubber such as thickness of the rubber not returning to thickness of the rubber due to residue solvent existing inside of the rubber and swelling of the rubber. Accordingly, abrasion resistance of the rubber may degrade. In addition, even if heating and drying is conducted to remove residue solvent, properties of the rubber may change and cleaning performance may degrade. Thus, it is preferable that temperature of heating and drying is lowered or vacuum drying is conducted instead of heating and drying. Accordingly, residue solvent concentration is reduced.

Next is a description of one specific example of the impregnation coating liquid.

<Impregnation Coating Liquid 1>
Ultraviolet ray hardening resin: X-DA (from Idemitsu Kosan Co., Ltd.) 50 parts, Number of functional groups 2
Polymerization initiator: Irgacure 184 (from Ciba Specialty Chemicals Inc.) 5 parts
Solvent: cyclohexanone 55 parts
<Impregnation Coating Liquid 2>
Ultraviolet ray hardening resin: A-DCP (from Shin-Nakamura Chemical Co., Ltd.) 50 parts, Number of functional groups 2
Polymerization initiator: Irgacure 184 (from Ciba Specialty Chemicals Inc.) 5 parts
Solvent: cyclohexanone 55 parts
<Impregnation Coating Liquid 3>
Ultraviolet ray hardening resin: X-A-201 (from Idemitsu Kosan Co., Ltd.) 50 parts, Number of functional groups 2
Polymerization initiator: Irgacure 184 (from Ciba Specialty Chemicals Inc.) 5 parts
Solvent: cyclohexanone 55 parts
<Impregnation Coating Liquid 4>
Ultraviolet ray hardening resin: ADTM (from Mitsubishi Gas Chemical Company, Inc.) 50 parts, Number of functional groups 3
Polymerization initiator: Irgacure 184 (from Ciba Specialty Chemicals Inc.) 5 parts
Solvent: cyclohexanone 55 parts
<Impregnation Coating Liquid 5>
Ultraviolet ray hardening resin 1: A-DCP (from Shin-Nakamura Chemical Co., Ltd.) 25 parts, Number of functional groups 2
Ultraviolet ray hardening resin 2: PETIA (from Daicel Cytec Ltd.) 25 parts, Number of functional groups 3
Polymerization initiator: Irgacure 184 (from Ciba Specialty Chemicals Inc.) 5 parts
Solvent: cyclohexanone 55 parts
<Impregnation Coating Liquid 6>
Ultraviolet ray hardening resin 1: X-A-201 (from Idemitsu Kosan Co., Ltd.) 25 parts, Number of functional groups 2
Ultraviolet ray hardening resin 2: PETIA (from Daicel Cytec Ltd.) 25 parts, Number of functional groups 3
Polymerization initiator: Irgacure 184 (from Ciba Specialty Chemicals Inc.) 5 parts
Solvent: cyclohexanone 55 parts
<Impregnation Coating Liquid 7>
Ultraviolet ray hardening resin: PETIA (from Daicel Cytec Ltd.) 50 parts, Number of functional groups 3
Polymerization initiator: Irgacure 184 (from Ciba Specialty Chemicals Inc.) 5 parts
SOLVENT: cyclohexanone 55 parts
<Impregnation Coating Liquid 8>
Ultraviolet ray hardening resin: DPHA (from Daicel Cytec Ltd.) 50 parts, Number of functional groups 6
Polymerization initiator: Irgacure 184 (from Ciba Specialty Chemicals Inc.) 5 parts
Solvent: cyclohexanone 55 parts Next is a description of an experiment in which the relationship of the Martens hardness at the vicinity of the edge portion 61 including the edge portion 61 of the cleaning blade 5 and the generation of filming is comparatively reviewed employing a low temperature fixing toner.

The low temperature fixing toner employed for the experiment has a glass transition temperature (Tg) of 45° C. In addition, the experiment is conducted under the following conditions to efficiently compare generation of filming in a comparatively short time period. The following conditions are conditions in which filming tend to be generated determined from findings accumulated so far by the inventors of the present invention.

Experiment Conditions

Under an environment of 32° C. and 54% in which an internal temperature of an apparatus tend to rise, continuous image output of 10000 sheets in approximately two hours is conducted. Output image is output as a full-page solid image on an A4 size recording sheet in order to maximize input of a toner to the surface of the drum shaped photoreceptor 10. Test apparatus is MPC5000 (from Ricoh Company, Ltd.). In the test apparatus, the cleaning blade 5 of the configuration of the process cartridge 121 shown in FIG. 2 is changed with each of the blade members having conditions of No. 1 to 27 shown in Table 1. Image output is conducted with two types of charging methods by the charging roller 41, a contacting direct current (DC) charging and a non-contacting alternating current (AC) charging. It is to be noted that generation of filming on the surface of the drum shaped photoreceptor 10 is known to occur easier in AC charging compared to DC charging from findings accumulated so far. Accordingly, as a condition for acceleration with respect to DC charging, evaluation is conducted with AC charging.

While employing the blade members having conditions of No. 1 to 27 shown in Table 1 as the cleaning blade 5, image output is conducted, filming on the surface of the drum shaped photoreceptor 10 is visually observed, occurrence of abnormal image (white spots) in the solid image is confirmed, and ranking is conducted.

Ranking Scale

Rank 5: Filming is not observed in visual observation and no abnormal images is seen in the solid image.

Rank 4: Minor filming is observed in visual observation and slight white spots are seen in the solid image. However, no problem for practical use.

Rank 3: Filming is observed in visual observation and white spots are seen in the solid image. May be a problem for practical use in some cases.

Rank 2: Filming is observed in visual observation and white spots are clearly seen in the solid image. Problematic for practical use.

Rank 1: Multiple filming is observed in visual observation and white spots are clearly seen in the solid image. Problematic for practical use.

In addition to evaluation results with respect to the above-described filming, evaluation of toner removal performance (hereinafter referred to as LL cleaning performance) under a low temperature 10° C. and a low humidity 15% environment is conducted.

Cleaning performance is evaluated in three grades of good, fair, and poor as described below. Cleaning failure is likely to be generated under the low temperature 10° C. and the low humidity 15% environment. Continuous image output of 3000 sheets is conducted in the low temperature 10° C. and the low humidity 15% environment after leaving a test apparatus under the low temperature 10° C. and the low humidity 15% environment for an entire day and night. Output image is output as a full-page solid image on an A4 size recording sheet in order to maximize input of a toner to the surface of the drum shaped photoreceptor 10. The test apparatus is, the same as described above, MPC5000 (from Ricoh Company, Ltd.). In the test apparatus, the cleaning blade 5 of the configuration of the process cartridge 121 shown in FIG. 2 is changed with each of the blade members having conditions of No. 1 to 27 shown in Table 1. Image output is conducted under the non-contacting AC charging in which cleaning performance is likely to decline compared to DC charging. While conducting image output, presence or absence of generation of cleaning failure is compared.

Cleaning Performance

Good: After passing through 3000 sheets, cleaning failure is not observed on the recording sheet. No problem for practical use.

Fair: After passing through 3000 sheets, residue toner that has slipped through is observed on the surface of the drum shaped photoreceptor 10. However, cleaning failure is not observed on the recording sheet. Thus, no problem for practical use.

Poor: After passing through 3000 sheets, cleaning failure is observed on the recording sheet. Problematic for practical use due to occurrence of abnormal images.

TABLE 1

| | Blade type | | | Filming rank Charging method | | Cleaning performance under low temperature |
|---|---|---|---|---|---|---|
| No. | Blade type | Edge layer | Backup layer | DC Charging | AC Charging | and low humidity |
| 1 | Single layer | 0.60 | — | 1 | 1 | Fair |
| 2 | Double layer | 0.61 | 0.77 | 1 | 1 | Fair |
| 3 | Double layer | 0.61 | 0.77 | 1 | 1 | Fair |
| 4 | Double layer | 0.73 | 0.77 | 2 | 1 | Fair |
| 5 | Double layer | 0.82 | 0.77 | 3 | 1 | Fair |
| 6 | Double layer | 0.98 | 0.77 | 4 | 3 | Fair |
| 7 | Double layer | 1.00 | 0.77 | 4 | 4 | Good |
| 8 | Single layer | 1.09 | — | 4 | 4 | Good |
| 9 | Double layer | 1.10 | 0.77 | 4 | 4 | Good |
| 10 | Double layer | 1.20 | 0.77 | 5 | 4 | Good |
| 11 | Double layer | 1.23 | 0.77 | 5 | 4 | Good |
| 12 | Double layer | 1.32 | 0.77 | 5 | 4 | Good |
| 13 | Double layer | 1.41 | 0.77 | 5 | 4 | Good |
| 14 | Single layer | 1.58 | — | 5 | 4 | Good |
| 15 | Double layer | 1.58 | 0.77 | 5 | 4 | Good |
| 16 | Double layer | 1.73 | 0.77 | 5 | 4 | Good |
| 17 | Single layer | 2.00 | — | 5 | 5 | Good |
| 18 | Double layer | 2.00 | 0.77 | 5 | 5 | Good |
| 19 | Double layer | 2.33 | 0.77 | 5 | 5 | Good |
| 20 | Double layer | 3.58 | 0.77 | 5 | 5 | Good |

TABLE 1-continued

| Blade type | | | | Filming rank Charging method | | Cleaning performance under low temperature and low humidity |
|---|---|---|---|---|---|---|
| No. | Blade type | Edge layer | Backup layer | DC Charging | AC Charging | |
| 21 | Double layer | 3.98 | 0.77 | 5 | 5 | Good |
| 22 | Double layer | 4.20 | 0.77 | 5 | 5 | Good |
| 23 | Single layer + Impregnation | 5.00 | — | 5 | 5 | Good |
| 24 | Single layer + Impregnation | 7.00 | — | 5 | 5 | Good |
| 25 | Single layer + Impregnation | 9.92 | — | 5 | 5 | Fair |
| 26 | Single layer + Impregnation | 10.10 | — | 5 | 5 | Fair |
| 27 | Single layer + Impregnation | 11.00 | — | 5 | 5 | Poor |

The blade members employed as the cleaning blade 5 have the following structure. The blade members No. 1, No. 8, No. 14, and No. 17 have a single layer structure and the blade members other than the above-described blade members No. 1, No. 8, No. 14, and No. 17 have a double layer structure formed of the edge layer 6 and the backup layer 7 shown in FIG. 3.

The blade members having the single layer structure may be regarded as being only formed of the edge layer 6 and no backup layer 7 is included.

In the blade members having the double layer structure, a Martens hardness of the backup layer 7 is 0.77 N/mm$^2$. A Martens hardness of the edge layer 6 is different for each of the blade members. A thickness of the edge layer 6 is the same for all the blade members and is 500 μm. A contact pressure of each of the blade members to the surface of the drum shaped photoreceptor 10 is the same for all the blade members and is determined as a linear pressure of 20 g/cm. Accordingly, a thickness of the backup layer 7 of each of the blade members having the double layer structure is different due to the backup layer 7 being appropriately adjusted so each of the blade members having the double layer structure obtains the above-described linear pressure of 20 g/cm.

The blade members No. 23 to No. 27 are blade members having high Martens hardness at a blade leading-edge due to impregnation of the ultraviolet ray hardening resin at the vicinity of the edge portion 61 with respect to the blade member No. 8 having the single layer structure as shown in FIG. 18A. The blade members No. 23 to No. 27 of Table 1 are formed by employing the above-described impregnation coating liquid 1 as the impregnation coating liquid and making impregnation time different from each other. For example, impregnation time of the blade member No. 23 is 30 minutes and impregnation time of the blade member No. 23 is 60 minutes.

Experiment Results

As shown in Table 1, the blade members of either the single layer structure or the double layer structure having the edge layer 6 with a Martens hardness of 0.98 N/mm$^2$ or more have, in DC charging, rank 4 or more with respect to filming that indicates no problem for practical use. Further, as the Martens hardness of the edge layer 6 of the blade members of either the single layer structure or the double layer structure increases, rank 4 or more with respect to filming in DC charging improves toward rank 5. In addition, even in AC charging in which generation of filming is known to occur easier, the blade members of either the single layer structure or the double layer structure having the edge layer 6 with a Martens hardness of 1.0 N/mm$^2$ or more have rank 4 or more with respect to filming that indicates no problem for practical use. Further, as the Martens hardness of the edge layer 6 of the blade members of either the single layer structure or the double layer structure increases, rank 4 or more with respect to filming in AC charging improves toward rank 5. Accordingly, by making the edge layer 6 have a Martens hardness of 1.0 N/mm$^2$ or more at the vicinity of the edge portion 61 including the edge portion 61, it can be understood that filming is no problem in practical use even when employing the low temperature fixing toner having a low glass transition temperature Tg.

In addition, in the blade member No. 27 having a Martens hardness exceeding 10 N/mm$^2$, presence or absence of cleaning failure is evaluated as poor under the low temperature 10° C. and the low humidity 15% environment. The evaluation of poor is considered to be due to decline in following capability with respect to the surface of the drum shaped photoreceptor 10 because of an excessively high Martens hardness at the vicinity of the edge portion 61. Thus, to obtain a balance of cleaning performance under the low temperature and the low humidity environment and filming, a Martens hardness of 1.0 N/mm$^2$ or more to 10 N/mm$^2$ or less is needed.

Next is a description of examples 1 to 3 of the cleaning blade 5 having the Martens hardness of 1.0 N/mm$^2$ or more at the vicinity of the edge portion 61 including the edge portion 61.

Example 1

Figure 5:
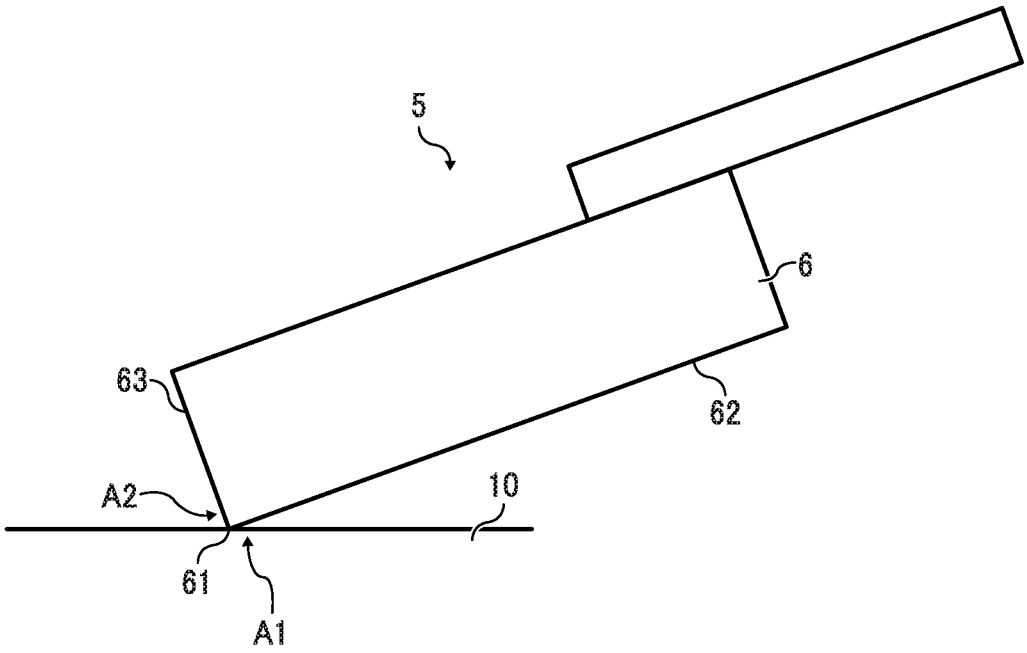
FIG. 5 is a schematic view of a configuration of a cleaning blade of example 1.

FIG. 5 is a schematic view of a configuration of the cleaning blade 5 of example 1. The cleaning blade 5 of example 1 is a blade member having the single layer structure. In the cleaning blade 5 having the single layer structure of only the edge layer 6, a value of a Martens hardness at a vicinity of an edge portion A1 measured from the opposing surface 62 or a value of a Martens hardness at a vicinity of an edge portion A2 measured from the leading-edge surface 63 may be 1.0 N/mm$^2$ or more. Accordingly, the cleaning blade 5 having the above-described measured value has a Martens hardness of 1.0 N/mm$^2$ or more at the vicinity of the edge portion 61 including the edge portion 61, and filming is suppressed even when employing the low temperature fixing toner as described above.

Example 2

Figure 6:
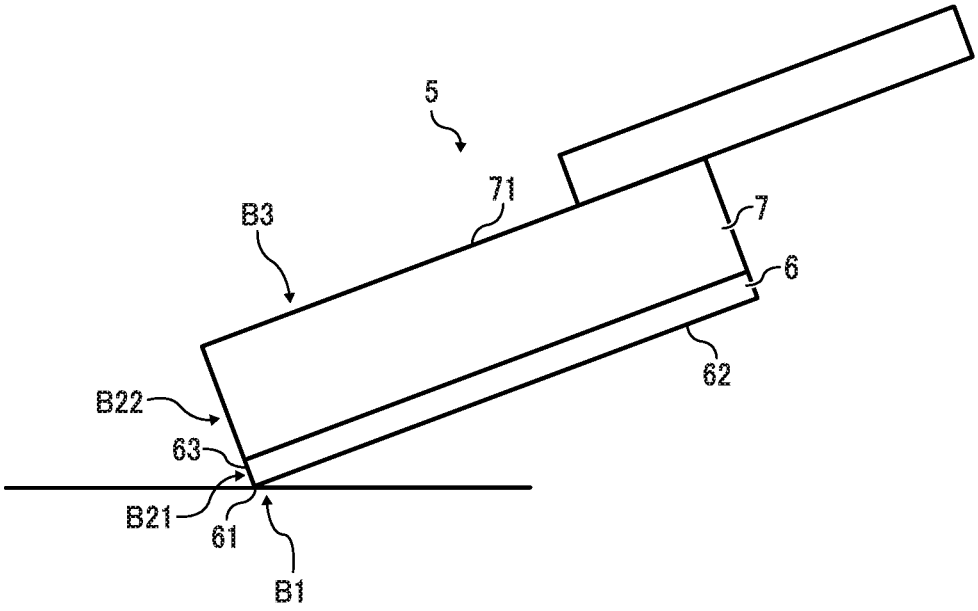
FIG. 6 is a schematic view of a configuration of a cleaning blade of example 2.

FIG. 6 is a schematic view of a configuration of the cleaning blade 5 of example 2. The cleaning blade 5 of example 2 is a blade member having the double layer structure formed of the edge layer 6 including the edge portion 61 and the backup layer 7. The blade member is formed by sequentially superimposing each layer with centrifugal casting. At present, centrifugal casting is common and is an effective manufacturing method.

In the cleaning blade 5 of example 2, a value of a Martens hardness at a vicinity of an edge portion B1 of the edge layer 6 measured from the opposing surface 62 or a value of a Martens hardness at a vicinity of an edge portion B21 of the edge layer 6 measured from the leading-edge surface 63 may be 1.0 N/mm$^2$ or more. Accordingly, the cleaning blade 5 having the above-described measured value has a Martens hardness of 1.0 N/mm$^2$ or more at the vicinity of the edge portion 61 including the edge portion 61, and filming is suppressed even when employing the low temperature fixing toner as described above.

It is to be noted that in the cleaning blade 5 of example 2, a value of a Martens hardness of the edge layer 6 (i.e., at the vicinity of the edge portion B21 in FIG. 6) measured from the leading-edge surface 63 and a value of a Martens hardness of the backup layer 7 (i.e., at a vicinity of an edge portion B22 in FIG. 6) measured from the leading-edge surface 63 is different. When a Martens hardness of the edge layer 6 is 1.0 N/mm$^2$ or more, it is preferable that a Martens hardness of the backup layer 7 is set smaller compared to the Martens hardness of the edge layer 6. In a rubber material having a Martens hardness of 1.0 N/mm$^2$ or more, a permanent elongation value (%) of the rubber material is comparatively large. When the rubber material having a Martens hardness of 1.0 N/mm2 or more is employed for a long time period, a problem of decline of a contact pressure is generated due to so-called fatigue. On the other hand, in a rubber material having a Martens hardness of less than 1.0 N/mm$^2$, a permanent elongation value (%) of the rubber material is comparatively small, and fatigue is less likely to occur. The cleaning blade 5 is configured to make a permanent elongation value (%) small, as a whole, by employing a combination of the rubber material having a Martens hardness of 1.0 N/mm$^2$ or more as the edge layer 6 and the rubber material having a Martens hardness of less than 1.0 N/mm$^2$ as the backup layer 7.

More specifically, like the blade members of Table 1, the rubber material having a Martens hardness in a range from 1.0 N/mm$^2$ to 4.2 N/mm$^2$ with a thickness of 500 μm serving as the edge layer 6 is combined to the rubber material having a Martens hardness in a range from 0.6 N/mm$^2$ to 0.8 N/mm$^2$ with a thickness in a range from 1000 μm to 1600 μm serving as the backup layer 7. Accordingly, even when employing the cleaning blade 5 for a long time period, a generation of decline of the contact pressure due to fatigue is less likely to occur. A Martens hardness and a thickness of the backup layer 7 may be appropriately adjusted according to a target contact pressure.

It is to be noted that in the cleaning blade 5 of FIG. 6 described above, the value of the Martens hardness of the edge layer 6 (i.e., at the vicinity of the edge portion B21 in FIG. 6) measured from the leading-edge surface 63 and the value of the Martens hardness of the backup layer 7 (i.e., at the vicinity of an edge portion B22 in FIG. 6) measured from the leading-edge surface 63 is different. However, difference in a value of a Martens hardness is not limited to the above-described difference between the edge layer 6 (i.e., at the vicinity of the edge portion B21 in FIG. 6) and the backup layer 7 (i.e., at the vicinity of an edge portion B22 in FIG. 6), and may be a difference between a value of a Martens hardness of at the vicinity of the edge portion B1 measured from the opposing surface 62 and a value of a Martens hardness of the backup layer 7 measured from a back surface 71 (i.e., B3 in FIG. 6) opposite the opposing surface 62.

A measurement of a Martens hardness is measured under a temperature of 23° C. and a humidity of 50% environment with the microhardness measurement instrument HM-2001, a pushing load of 1N, a pushing time of 10 seconds, and a creep time of 5 seconds. When measuring, the Vickers indenter is pushed into a rubber material in a range from approximately 5 μm to approximately 10 μm. Generally, in the measurement of the Martens hardness, it is known that a measurement value is influenced by a depth of around maximum 10 times with respect to an amount of pushing in of the Vickers indenter in a pushing in direction of the Vickers indenter. In other words, when the Vickers indenter pushes into the rubber material in a range from approximately 5 μm to approximately 10 μm, a region in a range from 50 μm to 100 μm of the rubber material with the pushed in Vickers indenter influences the measurement value.

In the cleaning blade 5 of Example 2, thickness of the edge layer 6 is 500 μm, thickness of the backup layer 7 is 1300 μm, and the amount of pushing in of the Vickers indenter when measuring a Martens hardness is in a range from approximately 5 μm to approximately 10 μm. By making the Vickers indenter push in at a measuring position that is perpendicular to a laminated direction from the opposing surface 62 (i.e., B1 in FIG. 6) or from the back surface 71 (i.e., B3 in FIG. 6), a measurement value of a Martens hardness of the edge layer 6 and the backup layer 7 that is not influenced by each other is obtained. Accordingly, irrespective to a measuring position of a Martens hardness, an accurate Martens hardness of the edge layer 6 and the backup layer 7 is determined. Further, an accurate comparison with respect to large/small relation of hardness is obtained. Thus, employing the above-described measurement value of a Martens hardness to determine a Martens hardness of the cleaning blade 5 is appropriate.

By contrast, a rubber hardness in a JIS-A measurement method with an indenter pushing in at a measuring position that is perpendicular to a laminated direction from the opposing surface 62 (i.e., B1 in FIG. 6) or from the back surface 71 (i.e., B3 in FIG. 6) is a measurement value in which the edge layer 6 and the backup layer 7 influences each other. For example, a blade member as follows is formed. The blade member has a double layer structure and is formed of a rubber material having a rubber hardness of 80 degrees measured with JIS-A measurement method, prior to laminating, serving as the edge layer 6 with 500 μm thickness, and a rubber material having a rubber hardness of 70 degrees measured with JIS-A measurement method, prior to laminating, serving as the backup layer 7 with 1300 μm thickness. After forming the blade member, when a rubber hardness of the edge layer 6 is measured with a typical JIS-A measurement method from the opposing surface 62 (i.e., B1 in FIG. 6), the rubber hardness is approximately 76 degrees due to influence from the backup layer 7 to the edge layer 6. In addition, when a rubber hardness of the backup layer 7 is measured with a typical JIS-A measurement method from the back surface 71 (i.e., B3 in FIG. 6), the rubber hardness is approximately 72 degrees due to influence from the edge layer 6 to the backup layer 7. Thus, after forming the blade member as a laminated blade as described above, there are cases in which a value of a measurement of a rubber hardness with JIS-A measurement method is different due to the edge layer 6 and the backup layer 7 influencing each other. Accordingly, depending upon a measuring position of a rubber hardness, an accurate hardness of the edge layer 6 and the backup layer 7 may not be determined. Further, an accurate comparison with respect to large/small relation of hardness may not be conducted. As described above, the measurement value of a Martens hardness is not influenced by other layers and even after forming a laminated blade, an accurate comparison with respect to large/small relation of hardness of an edge layer and a backup layer may be determined.

Example 3

Figure 7:
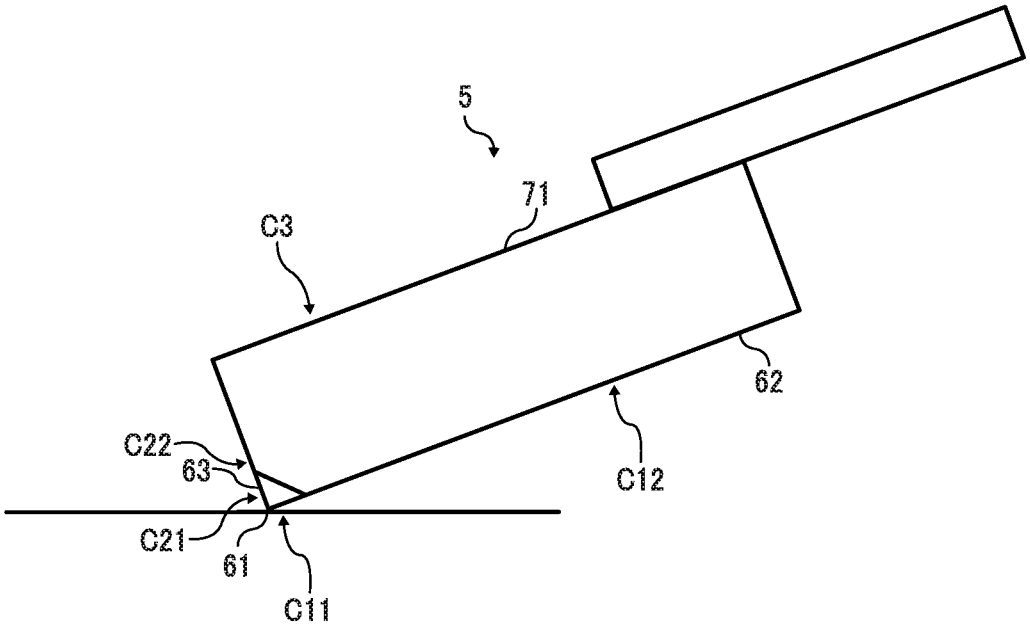
FIG. 7 is a schematic view of a configuration of a cleaning blade of example 3.

FIG. 7 is a schematic view of a configuration of the cleaning blade 5 of example 3. The cleaning blade 5 of example 3 is configured of a first rubber material at a vicinity of an edge portion C11 including the edge portion 61 of the opposing surface 62 and at a vicinity of an edge portion C21 of the leading-edge surface 63, and a second rubber material forming other regions. A Martens hardness of the first rubber material at the vicinity of the edge portion C11 including the edge portion 61 of the opposing surface 62 and at the vicinity of the edge portion C21 of the leading-edge surface 63 is different to a Martens hardness of the second rubber material forming other regions. In the cleaning blade 5 of example 3, a value of a Martens hardness at the vicinity of the edge portion C11 measured from the opposing surface 62 or a value of a Martens hardness at the vicinity of the edge portion C21 measured from the leading-edge surface 63 may be 1.0 $N/mm^2$ or more. Accordingly, a Martens hardness of at the vicinity of the edge portion 61 including the edge portion 61 is 1.0 $N/mm^2$ or more, and filming is suppressed even when employing the low temperature fixing toner as described above.

In the cleaning blade 5 of example 2, the edge layer 6 is formed of the rubber material in which all regions of the opposing surface 62 has a Martens hardness of 1.0 $N/mm^2$ or more. By contrast, in the cleaning blade 5 of example 3, only the first rubber material at the vicinity of the edge portion C11 including the edge portion 61 of the opposing surface 62 has a Martens hardness of 1.0 $N/mm^2$ or more. A Martens hardness of a region C12 away from the edge portion 61 of the opposing surface 62 and a Martens hardness of a region C22 away from the edge portion 61 of the leading-edge surface 63 are different to a Martens hardness at the vicinity of the edge portion 61. Further, a combination of the region C12 away from the edge portion 61 and the vicinity of the edge portion C11 as follows is preferable. Preferably, the region C12 away from the edge portion 61 has a Martens hardness of less than 1.0 $N/mm^2$, which is smaller than the Martens hardness at the vicinity of the edge portion C11 including the edge portion 61. In the above-described case, a Martens Hardness measured from the back surface 71 (i.e., C3 in FIG. 7) away from the edge portion 61 may be less than 1.0 $N/mm^2$. Accordingly, due to the same reason as Example 2, even when employing the cleaning blade 5 for a long time period, a generation of decline of a contact pressure due to fatigue is less likely to occur.

The following is a further detailed description of the cleaning blade 5 according to an embodiment of the present invention employing Example 2. Both the edge layer 6 and the backup layer 7 are formed of rubber materials such as urethane rubber. However, as described above, the Martens hardness of the rubber material forming the edge layer 6 is higher than the Martens hardness of the rubber material forming the backup layer 7.

Figure 8:
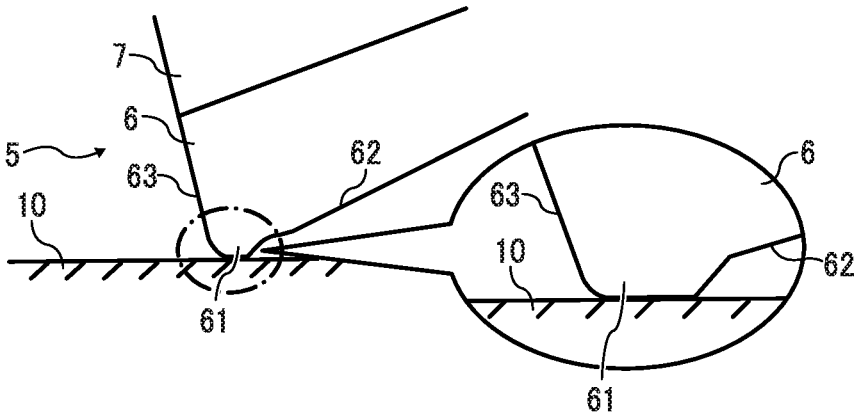
FIG. 8 is an enlarged view of deformation of an edge portion of the cleaning blade according to an embodiment of the present invention.

In the cleaning blade 5 according to an embodiment of the present invention, the value of Martens hardness at the vicinity of the edge portion 61 including the edge portion 61 is set to high hardness as described above. Accordingly, when the cleaning blade 5 contacts the surface of the drum shaped photoreceptor 10, the edge portion 61 deforms as if crushed as shown in FIG. 8. A state in which the edge portion 61, the vicinity of the edge portion 61 of the opposing surface 62, and the vicinity of the edge portion 61 of the leading-edge surface 63 contacts the surface of the drum shaped photoreceptor 10 at the same time is obtained. When the edge portion 61 is in the above-described state, formation of the wedge shape portion 204 as shown in the conventional cleaning blade 200 of FIG. 14B is suppressed. In other words, deformation of the edge portion 61 of the cleaning blade 5 is small and a contact surface area between the edge portion 61 and the surface of the drum shaped photoreceptor 10 does not become enlarged. Accordingly, a contact pressure to the surface of the drum shaped photoreceptor 10 becomes high and slipping through of the residue toner adhering to the surface of the drum shaped photoreceptor 10 is prevented. Thus, a generation of filming on the surface of the drum shaped photoreceptor 10 is suppressed and a generation of cleaning failure is suppressed.

Further, a 100% modulus value at 23° C. of the rubber material forming the edge layer 6 is larger than a 100% modulus value at 23° C. of the rubber material forming the backup layer 7. Preferably, the 100% modulus value at 23° C. of the rubber material forming the edge layer 6 is set in a range from 6 MPa to 12 MPa. With the above-described rubber material, due to suppressing the enlargement of the contact surface area of the edge portion 61, the contact pressure to the surface of the drum shaped photoreceptor 10 becomes high and cleaning performance may be enhanced. In addition, fatigue of the above-described rubber material due to contact with the surface of the drum shaped photoreceptor 10 over a long time period is suppressed and decline of the contact pressure may be prevented. Accordingly, good cleaning performance over a long time period is maintained. More specifically, urethane rubber having the 100% modulus value in the range from 6 MPa to 12 MPa at 23° C. may be employed as the edge layer 6 and urethane rubber having the 100% modulus value in a range from 4 MPa to 5 MPa at 23° C. may be employed as the backup layer 7.

In addition, the rubber material employed for the edge layer 6 and the backup layer 7 of the cleaning blade 5 according to an embodiment of the present invention preferably is, under a condition of having the above-described value of Martens hardness, urethane rubber having a tan δ peak temperature of less than 10° C. The rubber material having the tan δ peak temperature of less than 10° C. functions as the rubber material even under a low temperature environment such as an environment temperature of 10° C. Thus, the cleaning blade 5 functions as the rubber material having elasticity even under a conceivable low temperature environment in a typical office, and good cleaning performance is obtained due to the cleaning blade 5 having elasticity and contacting the surface of the drum shaped photoreceptor 10.

The following Table 2 shows other physical property values of the cleaning blade 5 in which the Martens hardness at the vicinity of the edge portion 61 including the edge portion 61 is 1.0 $N/mm^2$ or more. Table 2 shows examples of a combination of the edge layer 6 and the backup layer 7. Any of the combinations may be employed for the cleaning blade 5 according to an embodiment of the present invention.

TABLE 2

| Item | Example 1 | | Example 2 | | Example 3 | |
|---|---|---|---|---|---|---|
| | Edge layer | Backup layer | Edge layer | Backup layer | Edge layer | Backup layer |
| Martens hardness ($N/mm^2$) | 1.00 | 0.77 | 1.00 | 0.77 | 1.00 | 0.45 |
| Impact resilience (%): 23° C. | 25.5 | 34 | 15.5 | 34 | 25.5 | 12.5 |
| Young's modulus (Mpas) | 11 | 6.94 | 9.28 | 6.94 | 11 | 4.67 |
| 100% modulus (Mpas) | 6.4 | 3.9 | 6.1 | 3.9 | 6.4 | 2.4 |
| Permanent elongation | 1.89 | 0.56 | 1.59 | 0.58 | 1.89 | 0.09 |
| Tan δ peak temperature (° C.) | 5 | −7.7 | 15.7 | −7.7 | 5 | 8.8 |

In recent years, configurations as follows are known. A configuration in which a protectant such as a fatty acid metal salt or an inorganic lubricant is coated on the surface of the drum shaped photoreceptor 10 to enhance cleaning performance, and a configuration in which a lubricant having a fatty acid metal salt such as zinc stearate is added to a toner to enhance abrasion resistance of the drum shaped photoreceptor 10. Even with the above-described configurations, enhancing cleaning performance with the conventional cleaning blade 200 is difficult due to the edge portion 201 of the conventional cleaning blade 200 deforming into a wedge shape. The following is a detailed description of problems of the above-described configurations.

Figure 15A:
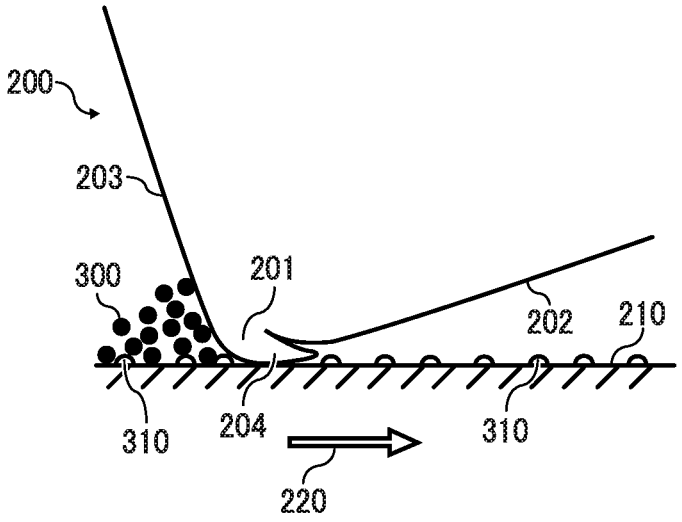
FIG. 15A RELATED ART
FIG. 15A is an enlarged view of cleaning the surface of the photoreceptor having a coating of a protectant with the conventional cleaning blade.
Figure 15B:
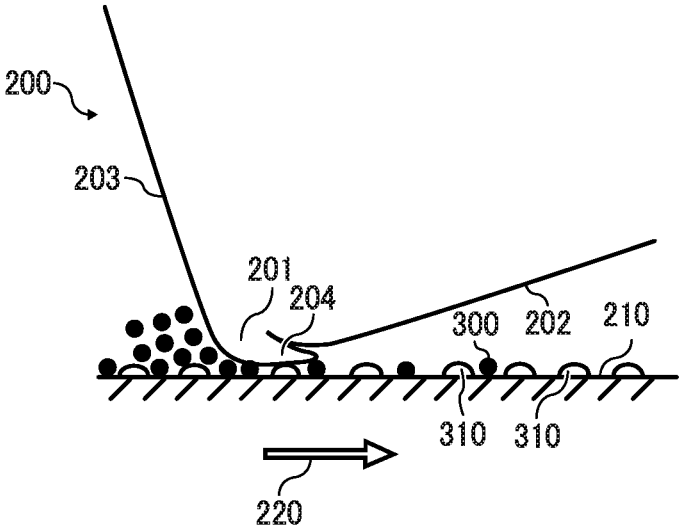
FIG. 15B RELATED ART
FIG. 15B is an enlarged view of cleaning the surface of the photoreceptor having the coating of the protectant with the conventional cleaning blade in a case of continued image formation.

FIG. 15A and FIG. 15B shows a state of cleaning by the conventional cleaning blade 200 shown in FIG. 14B with a coating of a protectant 310 on the surface of the photoreceptor 210. In FIG. 15A and FIG. 15B, a residue toner 300 and the protectant 310 are shown.

As shown in FIG. 15A, the edge portion 201 of the conventional cleaning blade 200 largely deforms into the wedge shape portion 204 when the edge portion 201 contacts the surface of the photoreceptor 210. Due to the wedge shape portion 204 contacting the surface of the photoreceptor 210, a contact pressure of the conventional cleaning blade 200 does not increase and cleaning performance declines. As a result, the protectant 310 on the surface of the photoreceptor 210 slips through the conventional cleaning blade 200 in a state of adhering to the surface of the photoreceptor 210.

FIG. 15B shows a state of cleaning by the conventional cleaning blade 200 shown in FIG. 14B with the coating of the protectant 310 on the surface of the photoreceptor 210 in a case of continued image formation. Due to the protectant 310 continuously slipping through the conventional cleaning blade 200, the protectant 310 becomes large on the surface of the photoreceptor 210. Accordingly, the residue toner 300 slips through the conventional cleaning blade 200 easier. As a result, an abnormal image such as white spots is generated and vertical streaks are generated due to cleaning failure.

Figure 16:
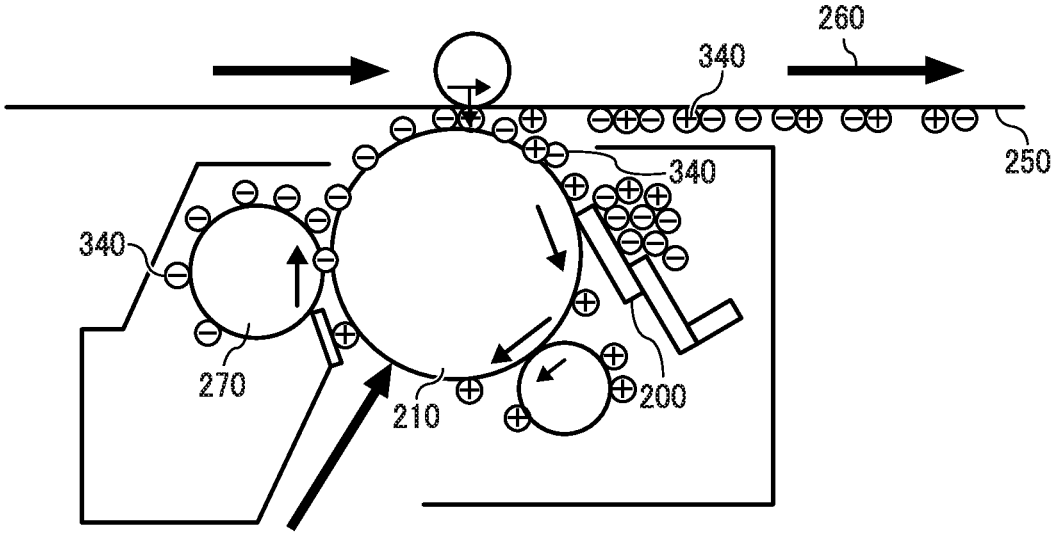
FIG. 16 RELATED ART
FIG. 16 is a schematic view of a state of cleaning a lubricant added toner with the conventional cleaning blade.

FIG. 16 is a schematic view of a state of cleaning a lubricant added toner 340 with the conventional cleaning blade 200. The lubricant added toner 340 includes a lubricant having zinc stearate added to a toner of the lubricant added toner 340. The lubricant added toner 340 is employed to enhance abrasion resistance of the photoreceptor 210. In FIG. 16, an intermediate transfer belt 250 contacts the surface of the photoreceptor 210 and moves in the direction of an arrow 260. In FIG. 16, an electrostatic latent image is formed on the surface of the photoreceptor 210 and is developed into a toner image, the toner image is transferred from the surface of the photoreceptor 210 to the intermediate transfer belt 250, and the toner image on the intermediate transfer belt 250 is transferred from the intermediate transfer belt 250 to a recording medium. A developing roller 270 supplies the lubricant added toner 340 to the photoreceptor 210.

In the case of employing the lubricant added toner 340 including the lubricant having zinc stearate added to the toner of the lubricant added toner 340, chargeability of the lubricant added toner 340 declines due to the addition of the lubricant and charge amount of the lubricant added toner 340 becomes small. The lubricant added toner 340 in a state of having small charge amount is transferred to the intermediate transfer belt 250 by a transferring current and oppositely charged. Due to the lubricant added toner 340 having small charge amount, an amount of the lubricant added toner 340 oppositely charged by a transfer charger is large or an amount of opposite charging by the transfer charger is large in transfer of the lubricant added toner 340 to the intermediate transfer belt 250. Accordingly, an amount of the lubricant added toner 340 not transferred to the intermediate transfer belt 250 becoming a residue toner on the surface of the photoreceptor 210 becomes increasingly large. The increasingly large amount of the residue toner reaches the conventional cleaning blade 200 and the surface of the photoreceptor 210 is cleaned.

Even in the configuration of FIG. 16, the wedge shape portion 204 is formed due to the edge portion 201 of the conventional cleaning blade 200 largely deforming and the wedge shape portion 204 contacts the surface of the photoreceptor 210. Accordingly, a contact pressure of the conventional cleaning blade 200 does not increase and cleaning performance declines. As a result, an amount of the lubricant added toner 340 that slips through the conventional cleaning blade 200 increases, and cleaning failure is generated and image quality of an image declines.

Figure 17:
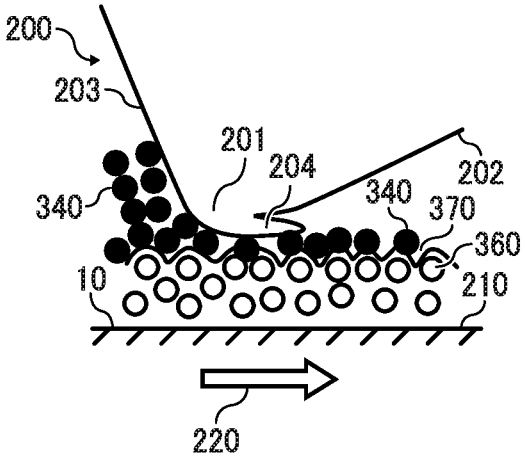
FIG. 17 RELATED ART
FIG. 17 is an enlarged view of the edge portion of the conventional cleaning blade with respect to a case of inorganic fine particles included on the surface of the photoreceptor.

Further, there is a configuration of employing a high durability photoreceptor including inorganic fine particles on the surface of the high durability photoreceptor serving as the photoreceptor 210 in addition to adding a lubricant having zinc stearate to a toner to enhance abrasion resistance of the surface of the photoreceptor 210. FIG. 17 is a cross-sectional view of the edge portion 201 of the conventional cleaning blade 200 with respect to a case of inorganic fine particles 360 included on the surface of the photoreceptor 210.

The surface of the photoreceptor 210 having the inorganic fine particles 360 has a fine uneven surface 370 due to the inorganic fine particles 360. Chargeability of the lubricant added toner 340 declines due to the addition of the lubricant and charge amount of the lubricant added toner 340 becomes small. Thus, an amount of the lubricant added toner 340 being oppositely charged by a transfer charger increases. As a result, an adhesive force of the lubricant added toner 340, not transferred to the intermediate transfer belt 250, remaining on the surface of the photoreceptor 210 becomes large.

In the above-described configuration, the wedge shape portion 204 is formed due to the edge portion 201 of the conventional cleaning blade 200 largely deforming, and contact pressure does not increase due to the wedge shape portion 204 contacting the surface of the photoreceptor 210. In addition, a state of contact of the conventional cleaning blade 200 to the surface of the photoreceptor 210 is non-uniform and unstable due to the fine uneven surface 370 of the surface of the photoreceptor. As a result, an amount of the lubricant added toner 340 that slips through the conventional cleaning blade 200 increases, and cleaning failure is generated and image quality of an image being formed declines.

Employing the cleaning blade 5 according to an embodiment of the present invention having the Martens hardness of 1.0 $N/mm^2$ or more at the vicinity of the edge portion 61 including the edge portion 61 is effective with respect to the above-described generation of abnormal image, generation of cleaning failure, and decline in image quality of a forming image. Next, advantageous effects of the cleaning blade 5 according to an embodiment of the present invention is described by employing the cleaning blade 5 in another example of a process cartridge that may be used with the printer 100 according to an embodiment of the present invention.

Figure 9:
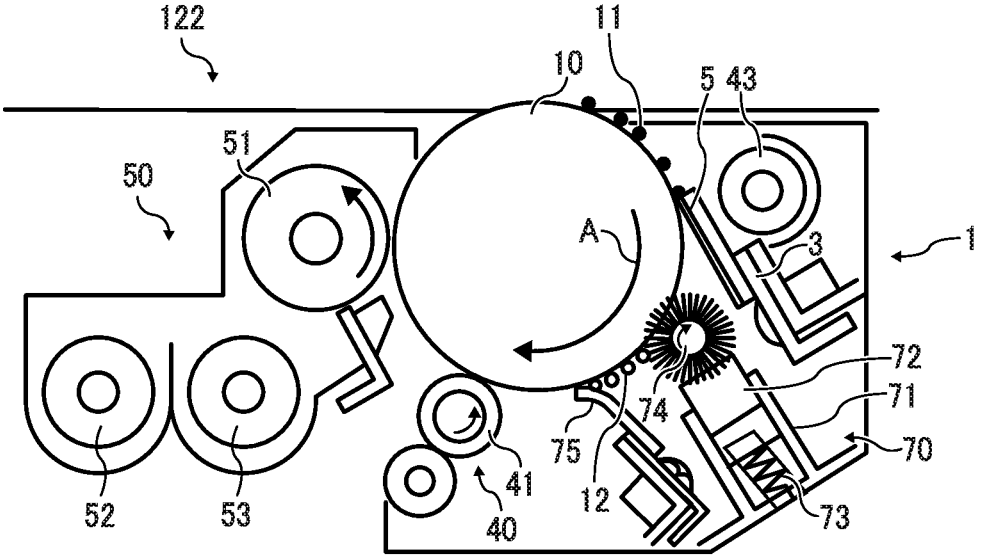
FIG. 9 is a schematic view of another example of a configuration of the process cartridge provided in the printer.

FIG. 9 is a schematic view of another example of a configuration of the process cartridge 122 provided in the printer 100 according to an embodiment of the present invention. The process cartridge 122 has a configuration including a protectant coating device 70 that coats a protectant 12 on the surface of the drum shaped photoreceptor 10. In the process cartridge 122, a roller member serving as the charging roller 41 contacts the surface of the drum shaped photoreceptor 10 and charges the surface of the drum shaped photoreceptor 10. An alternating current (AC) voltage is applied to the charging roller 41. The roller member is provided opposite the surface of the drum shaped photoreceptor 10. There is a minute gap between the roller member and the surface of the drum shaped photoreceptor 10. The protectant coating device 70 is provided, with respect to the moving direction A of the surface of the drum shaped photoreceptor 10, at a downstream side of a cleaning device 1. Accordingly, the protectant 12 is coated on to the surface of the drum shaped photoreceptor 10 in a stable manner.

The protectant coating device 70 includes a solid protectant 72 having a stick shape held by a holding cylinder 71. The solid protectant 72 is biased toward the surface of the drum shaped photoreceptor 10 by a compression spring 73 inside the holding cylinder 71. A brush roller 74 that rotates is provided between the solid protectant 72 and the surface of the drum shaped photoreceptor 10. The brush roller 74 scrapes the solid protectant 72 by rotating and coats the protectant 12 to the surface of the drum shaped photoreceptor 10. A coating blade 75 is provided, with respect to the moving direction A of the surface of the drum shaped photoreceptor 10, at a downstream side of the brush roller 74. The coating blade 75 makes the protectant 12 on the surface of the drum shaped photoreceptor 10 into a thin film.

The brush roller 74 is rotationally driven in a reverse direction with respect to the moving direction A of the surface of the drum shaped photoreceptor 10. Due to a large abrasion effect between the brush roller 74 and the surface of the drum shaped photoreceptor 10, the protectant 12 is efficiently coated on the surface of the drum shaped photoreceptor 10. The coating blade 75 contacts the surface of the drum shaped photoreceptor 10 in a trailing manner with respect to the moving direction A of the surface of the drum shaped photoreceptor 10. Accordingly, the protectant 12 is not scraped off from the surface of the drum shaped photoreceptor 10 and the coated protectant 12 is efficiently made into the thin film.

The protectant 12 includes a fatty acid metal salt and an inorganic lubricant. The fatty acid metal salt in the protectant 12 is broken by a charging current and prevents the surface of the drum shaped photoreceptor 10 from being broken. At the same time, the inorganic lubricant that is not broken by the charging current maintains the lubricating effect of the protectant 12 in a good state compared to a case of the protectant 12 including only the fatty acid metal salt. Accordingly, good cleaning of the surface of the drum shaped photoreceptor 10 is maintained.

Specific examples of the fatty acid metal salt include, but are not limited to, barium stearate, lead stearate, iron stearate, nickel stearate, cobalt stearate, copper stearate, strontium stearate, calcium stearate, cadmium stearate, magnesium stearate, zinc stearate, zinc oleate, magnesium oleate, oleic acid iron, oleic acid cobalt, copper oleate, lead oleate, oleic acid manganese, palmitic acid zinc, palmitic acid cobalt, palmitic acid lead, palmitic acid magnesium, palmitic acid aluminum, palmitic acid calcium, caprylic acid lead, capric acid lead, linolenic acid zinc, linolenic acid cobalt, linolenic acid calcium, ricinoleic acid zinc, ricinoleic acid cadmium, and a combination of the above-described fatty acid metal salts. In addition, the above-described fatty acid metal salts may be used in combination. In the above-described fatty metal salts, zinc stearate particularly has good film forming property and is preferably used.

The inorganic lubricant is an inorganic compound that lubricates by cleaving itself or generates internal slipping. Specific examples of material of the inorganic lubricant include, but are not limited to, talc, mica, boron nitride, molybdenum disulfide, tungsten disulfide, kaolin, smectite, hydrotalcite compound, calcium fluoride, graphite, plate-shaped alumina, sericite, and synthetic mica. In the above-described inorganic lubricants, boron nitride has a configuration in which atoms are firmly interlocked in a hexagonal mesh form and layers of the hexagonal mesh form overlap over a wide space. A weak Van der Waals force is the only acting force between layers. Accordingly, boron nitride easily cleaves itself and lubricates and is preferably used. It is to be noted that the above-described inorganic lubricants may be subjected to surface treatment according to need to impart hydrophobicity.

In the process cartridge 122, by making the cleaning blade 5 have the Martens hardness of 1.0 $N/mm^2$ or more at the vicinity of the edge portion 61 including the edge portion 61 that is high hardness, suppression of the leading-edge surface 63 being drawn into a downstream side of the moving direction A according to the movement of the surface of the drum shaped photoreceptor 10 is obtained. Accordingly, a state of smaller deformation of the edge portion 61 is obtained compared to the conventional cleaning blade 200. Accordingly, slipping through of the residue toner 11 is suppressed. Thus, a generation of filming on the surface of the drum shaped photoreceptor 10 is suppressed and a generation of cleaning failure is suppressed.

Figure 10:
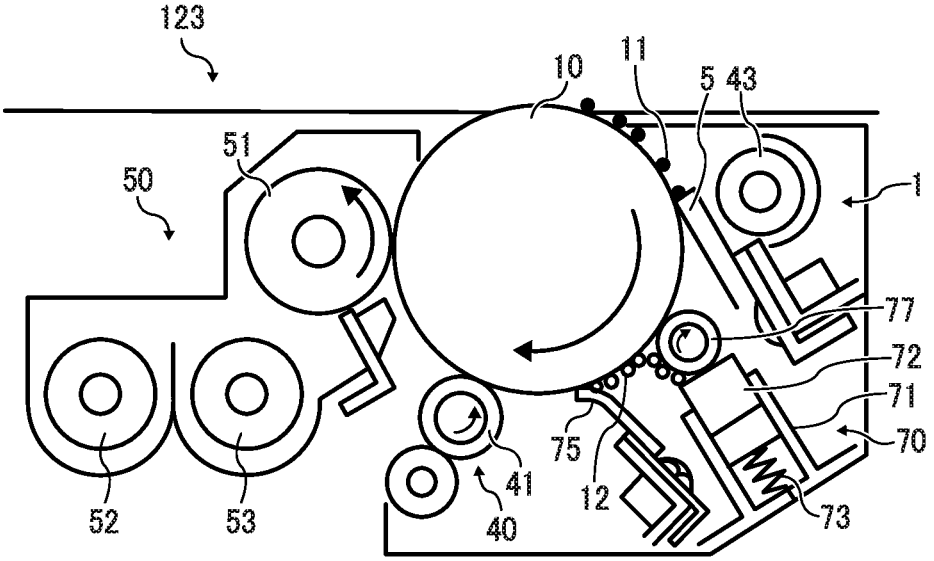
FIG. 10 is a schematic view of still another example of a configuration of the process cartridge provided in the printer.

FIG. 10 is a schematic view of a configuration of a process cartridge 123 in which a foamed urethane roller 77 is employed instead of the brush roller 74 with respect to the protectant coating device 70 of FIG. 9. The configuration of the process cartridge 123 is the same as the process cartridge 122 in FIG. 9 except for the foamed urethane roller 77. The foamed urethane roller 77 is rotationally driven in a reverse direction with respect to the moving direction A of the surface of the drum shaped photoreceptor 10. Due to the foamed urethane roller 77 being rotationally driven, the protectant 12 of the solid protectant 72 is coated on the surface of the drum shaped photoreceptor 10. By employing the foamed urethane roller 77, degradation of coating performance of the protectant 12 over time due to fatigue as in a case of employing the brush roller 74 is overcome and stable coating of the protectant 12 is obtained. Accordingly, a setting of a coating amount of the protectant 12 with consideration to decline of the coating amount of the protectant 12 over time is unnecessary, and efficient coating of the protectant 12 is obtained.

In the process cartridge 123, by making the cleaning blade 5 have the Martens hardness of 1.0 $N/mm^2$ or more at the vicinity of the edge portion 61 including the edge portion 61 that is high hardness, suppression of the leading-edge surface 63 being drawn into a downstream side of the moving direction A according to the movement of the surface of the drum shaped photoreceptor 10 is obtained. Accordingly, a state of smaller deformation of the edge portion 61 is obtained compared to the conventional cleaning blade 200. Accordingly, slipping through of the residue toner 11 is suppressed. Thus, a generation of filming on the surface of the drum shaped photoreceptor 10 is suppressed and a generation of cleaning failure is suppressed.

Further, in the printer 100 according to an embodiment of the present invention, the drum shaped photoreceptor 10 serving as the electrostatic latent image carrier may include inorganic fine particles on the outermost surface of the drum shaped photoreceptor 10. By including the inorganic fine particles on the outermost surface of the drum shaped photoreceptor 10, abrasion resistance of the surface of the drum shaped photoreceptor 10 is enhanced.

Specific examples of the inorganic fine particles include, but are not limited to, inorganic materials such as metal particles of copper, tin, aluminum, and indium; metal oxides such as silicon oxide, silica, tin oxide, zinc oxide, titanium oxide, indium oxide, antimony oxide, bismuth oxide, antimony doped tin oxide, and tin doped indium oxide; and potassium titanate. In the above-described examples of inorganic fine particles, particularly metal oxides work well. Further, silicon oxide, aluminum oxide, and titanium oxide may be effectively employed.

Figure 13D:
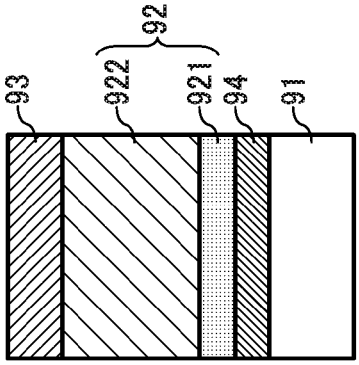
FIG. 13A, FIG. 13B, FIG. 13C, and FIG. 13D are schematic views of a layer configuration of the drum shaped photoreceptor.
Figure 13C:
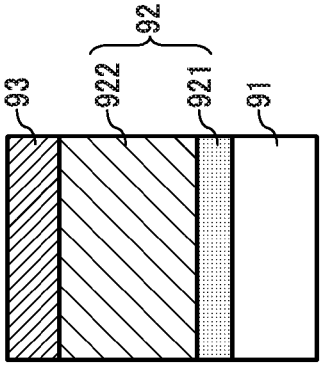
Figure 13B:
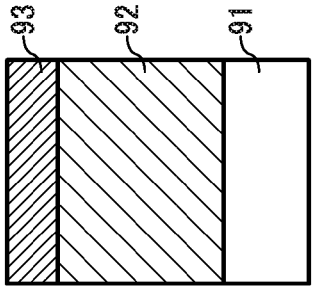

From a standpoint of abrasion resistance or light transmission rate of a surface layer 93 including the inorganic fine particles as shown in FIG. 13B to FIG. 13D, preferably an average primary particle diameter of the inorganic fine particles is in a range from 0.01 μm to 0.5 μm. When the average primary particle diameter of the inorganic fine particles is 0.01 μm or less, abrasion resistance declines and dispersibility declines. When the average primary particle diameter of the inorganic fine particles is 0.5 μm or more, settleability of the inorganic fine particles in a dispersion liquid is furthered and filming of the residue toner 11 may be generated.

The higher an addition amount of the inorganic fine particles on the outermost surface of the drum shaped photoreceptor 10, the higher abrasion resistance of the outermost surface of the drum shaped photoreceptor 10 becomes. However, when the addition amount of the inorganic fine particles is too high, side effects of increase of residue potential and decline of writing light transmission rate of a protectant layer may be generated. Accordingly, the addition amount of the inorganic fine particles is 30% by weight or less with respect to an approximate total solid content, preferably 20% by weight or less. A lower limit value of the addition amount of the inorganic fine particles is normally 3% by weight.

From a standpoint of dispersibility of the inorganic fine particles, preferably the inorganic fine particles are subjected to at least one type of surface treatment with a surface treatment agent. Decline of dispersibility of the inorganic fine particles causes not only increase of residue potential but also decline of transparency of a coat, generates coating defects, and decline of abrasion resistance. Accordingly, decline of dispersibility of the inorganic fine particles may lead to problems preventing high durability and high image quality.

Figure 11:
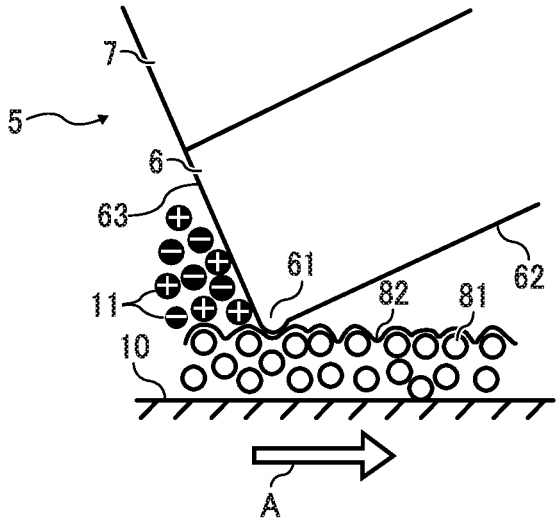
FIG. 11 is an enlarged view of the edge portion of the cleaning blade according to an embodiment of the present invention with respect to the drum shaped photoreceptor including inorganic fine particles.

FIG. 11 is a cross-sectional view of the edge portion 61 with respect to the surface of the drum shaped photoreceptor 10 having inorganic fine particles 81 on the surface of the drum shaped photoreceptor 10.

A fine uneven surface 82 is formed on the surface of the drum shaped photoreceptor 10 due to including the inorganic fine particles 81. The cleaning blade 5 contacts the fine uneven surface 82 formed on the surface of the drum shaped photoreceptor 10. In the cleaning blade 5, as described above, the value of Martens hardness at the vicinity of the edge portion 61 including the edge portion 61 of the edge layer 6 is set to 1.0 $N/mm^2$ or more that is high hardness. Accordingly, when the cleaning blade 5 contacts the surface of the drum shaped photoreceptor 10, the edge portion 61 deforms and a state in which the rubber material at the vicinity of the edge portion 61 of the opposing surface 62 and the rubber material at the vicinity of the edge portion 61 of the leading-edge surface 63 contacts the surface of the drum shaped photoreceptor 10 at the same time is obtained. Accordingly, formation of a wedge shape portion at a contact portion with the surface of the drum shaped photoreceptor 10 is suppressed. In other words, drawing in of the edge portion 61 to a downstream side of the moving direction A is suppressed due to the edge portion 61 being difficult to deform. Accordingly, the edge portion 61 stably contacts the surface of the drum shaped photoreceptor 10 even with respect to non-uniform unevenness of the surface of the drum shaped photoreceptor 10. Further, the edge layer 6 of the cleaning blade 5 is hard and the edge portion 61 is difficult to deform. Accordingly, due to drawing in of the edge portion 61 to a downstream side of the moving direction A being suppressed, a contact surface area between the edge portion 61 and the surface of the drum shaped photoreceptor 10 becomes small and contact pressure to the surface of the drum shaped photoreceptor 10 increases. Thus, stopping performance of the cleaning blade 5 is enhanced. Accordingly, even when the fine uneven surface 82 due to the inorganic fine particles 81 is formed on the surface of the drum shaped photoreceptor 10, slipping through of the residue toner 11 is suppressed and a generation of cleaning failure is prevented. In addition, due to the backup layer 7 having a lower hardness compared to the edge layer 6, fatigue due to contact with the surface of the drum shaped photoreceptor 10 over a long time period is suppressed and good cleaning performance over a long time period is maintained.

In an embodiment of the present invention, a toner having a fatty acid metal salt may be employed. The developing member 50 develops the electrostatic latent image on the surface of the drum shaped photoreceptor 10 with the toner having the fatty acid metal salt. Due to developing with the toner having the fatty acid metal salt, good lubrication of the surface of the drum shaped photoreceptor 10 is obtained and abrasion resistance of the surface of the drum shaped photoreceptor 10 may be enhanced.

The fatty acid metal salt may be the same as the fatty acid metal salt employed for the surface of the drum shaped photoreceptor 10. In other words, specific examples of the fatty acid metal salt include, but are not limited to, barium stearate, lead stearate, iron stearate, nickel stearate, cobalt stearate, copper stearate, strontium stearate, calcium stearate, cadmium stearate, magnesium stearate, zinc stearate, zinc oleate, magnesium oleate, oleic acid iron, oleic acid cobalt, copper oleate, lead oleate, oleic acid manganese, palmitic acid zinc, palmitic acid cobalt, palmitic acid lead, palmitic acid magnesium, palmitic acid aluminum, palmitic acid calcium, caprylic acid lead, capric acid lead, linolenic acid zinc, linolenic acid cobalt, linolenic acid calcium, ricinoleic acid zinc, ricinoleic acid cadmium, and a combination of the above-described fatty acid metal salts. In addition, the above-described fatty acid metal salts may be used in combination. In the above-described fatty metal salts, zinc stearate particularly has good film forming property when developing and is most preferably used.

In an embodiment of the present invention, a polymerized toner may be employed as the toner. The developing member 50 develops the electrostatic latent image on the surface of the drum shaped photoreceptor 10 with the polymerized toner. The polymerized toner is employed to enhance image quality. The polymerized toner is manufactured with a dispersion polymerization method, an emulsion polymerization method, and a suspension polymerization method in which high circularity and small particle diameter is obtained easier. Particularly, employing the polymerized toner having an average circularity of 0.97 or more and a volume average particle diameter of 5.5 μm or less is preferable. By employing the polymerized toner having the average circularity of 0.97 or more and the volume average particle diameter of 5.5 μm or less, a further high resolution image may be formed.

Figure 12A:
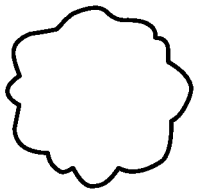
FIG. 12A is a front view of a shape of an actual projected polymerized toner.
Figure 12B:
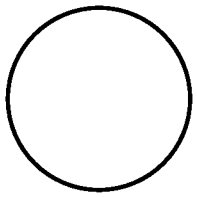
FIG. 12B is a front view of a polymerized toner having the same area as the actual projected polymerized toner in a shape of an exact circle.

"Circularity" is the average circularity measured by a flow-type particle image analyzer FPIA-1000 (product name, from Sysmex Corporation). More specifically, 0.1 ml to 0.5 ml of a surfactant (preferably, alkylbenzene sulfonate) serving as a dispersant is put in 100 ml to 150 ml of water from which impure solid materials are previously removed, and approximately 0.1 g to approximately 0.5 g of a measuring sample (i.e., the polymerized toner) is added to the water having the dispersant obtaining a suspension liquid. The suspension liquid including the dispersed measuring sample is subjected to a dispersion treatment with an ultrasonic disperser for approximately 1 minute to approximately 3 minutes to prepare a dispersion liquid having a dispersion liquid concentration in a range from 3,000 to 10,000 pieces/μl, and a toner shape and distribution are measured using the above-described analyzer. Based upon measured results, the average circularity value is determined from C2/C1. As shown in FIG. 12A, C1 represents outer circumference length of the actual projected polymerized toner shape and S represents area of the actual projected polymerized toner. As shown in FIG. 12B, C2 represents outer circumference length of an exact circle having the same area S of the actual projected polymerized toner.

"Volume average particle diameter" may be measured with a Coulter counter method. More specifically, number distribution and volume distribution of the polymerized toner is measured with a Coulter Multisizer 2e (from Beckman Coulter Inc.). Data of the number distribution and volume distribution is transferred to a personal computer via an interface (from Nikkaki) and analyzed. A 1% NaCl aqueous solution employing a primary sodium chloride is prepared as an electrolytic aqueous solution. First, 0.1 ml to 5 ml of a surfactant, preferably alkylbenzene sulfonate, is added as a dispersant to 100 ml to 150 ml of the electrolytic aqueous solution. Then, 2 mg to 20 mg of a measuring sample (i.e., the polymerized toner) is added to the electrolytic aqueous solution, and the electrolytic aqueous solution having the measuring sample is subjected to a dispersion treatment with an ultrasonic disperser for approximately 1 minute to approximately 3 minutes obtaining a solution. Next, 100 ml to 200 ml of the electrolytic aqueous solution is put in another beaker, and the solution obtained after dispersion treatment is added to the electrolytic aqueous solution to obtain a predetermined concentration. The solution obtained after dispersion treatment added with the electrolytic aqueous solution having the predetermined concentration is subjected to the above-described Coulter Multisizer 2e. Using an aperture of 100 μm, particle diameter of 50,000 of the polymerized toner particles is measured. Number of channels used in the measurement is thirteen. The ranges of the channels are from 2.00 μm to less than 2.52 μm, from 2.52 μm to less than 3.17 μm, from 3.17 μm to less than 4.00 μm, from 4.00 μm to less than 5.04 μm, from 5.04 μm to less than 6.35 μm, from 6.35 μm to less than 8.00 μm, from 8.00 μm to less than 10.08 μm, from 10.08 μm to less than 12.70 μm, from 12.70 μm to less than 16.00 μm, from 16.00 μm to less than 20.20 μm, from 20.20 μm to less than 25.40 μm, from 25.40 μm to less than 32.00 μm, and from 32.00 μm to less than 40.30 μm. The polymerized toner particles that are measured are in a range from 2.00 μm or more to 32.0 μm. Based upon a relational expression "volume average particle diameter=$\Sigma XfV/\Sigma fV$", the volume average particle diameter is determined. "X" represents typical diameter in each channel. "V" represents volume corresponding to typical diameter of each channel. "f" represents number of the polymerized toner particles in each channel.

By employing the above-described polymerized toner for developing the electrostatic latent image on the surface of the drum shaped photoreceptor 10, a high resolution image may be formed. By employing the above-described polymerized toner including the above-described fatty acid metal salt, the electrostatic latent image on the surface of the drum shaped photoreceptor 10 is formed, and the cleaning blade 5 cleans the surface of the drum shaped photoreceptor 10 after the electrostatic latent image on the surface of the drum shaped photoreceptor 10 is transferred to a transfer medium.

In the cleaning blade 5, as described above, the value of Martens hardness at the vicinity of the edge portion 61 including the edge portion 61 of the edge layer 6 is set to 1.0 N/mm$^2$ or more that is high hardness. Accordingly, when the cleaning blade 5 contacts the surface of the drum shaped photoreceptor 10, the edge portion 61 deforms and a state in which the rubber material at the vicinity of the edge portion 61 of the opposing surface 62 and the rubber material at the vicinity of the edge portion 61 of the leading-edge surface 63 contacts the surface of the drum shaped photoreceptor 10 at the same time is obtained. Accordingly, formation of a wedge shape portion at a contact portion with the surface of the drum shaped photoreceptor 10 is suppressed. Accordingly, slipping through of the residue toner 11 may be suppressed. In addition, the deformation of the edge portion 61 is small and enlargement of the contact surface area with the surface of the drum shaped photoreceptor 10 may be suppressed. Accordingly, the contact pressure to the surface of the drum shaped photoreceptor 10 is maintained, and extensive cleaning performance is exhibited. In addition, due to the backup layer 7 having a lower hardness compared to the edge layer 6, fatigue due to contact with the surface of the drum shaped photoreceptor 10 over a long time period is suppressed and good cleaning performance over a long time period is maintained.

The following FIGS. 13A, 13B, 13C, and 13D are a schematic view of a layer configuration of the drum shaped photoreceptor 10 serving as an image carrier that may be employed in an embodiment of the present invention.

Figure 13A:
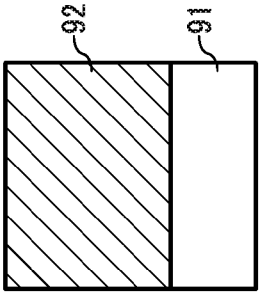

FIG. 13A is an example of a layer configuration including a photosensitive layer 92 having inorganic fine particles around the surface laminated on a conductive support body 91. FIG. 13B is an example of a layer configuration including the photosensitive layer 92 and a surface layer 93 having inorganic fine particles sequentially laminated on the conductive support body 91. FIG. 13C is an example of a layer configuration including the photosensitive layer 92 including a charge generation layer 921 and a charge transport layer 922 sequentially laminated on the conductive support body 91, and the surface layer 93 having inorganic fine particles further laminated on the photosensitive layer 92. FIG. 13D is an example of a layer configuration including an underlying layer 94 on the conductive support body 91, the photosensitive layer 92 including the charge generation layer 921 and the charge transport layer 922 sequentially laminated on the underlying layer 94, and the surface layer 93 having inorganic fine particles further laminated on the photosensitive layer 92.

The drum shaped photoreceptor 10 according to an embodiment of the present invention may arbitrarily have other layer combinations as long as a configuration has at least the photosensitive layer 92 and the surface layer 93 laminated on the conductive support body 91.

As shown in FIG. 13A, in a case in which an outermost layer is the photosensitive layer 92, the photosensitive layer 92 includes inorganic fine particles. In a case of a configuration of the photosensitive layer 92 including the charge generation layer 921 and the charge transport layer 922 are sequentially laminated, the outermost layer is the charge transport layer 922 and the charge transport layer 922 includes inorganic fine particles.

Specific examples of the inorganic fine particles include, but are not limited to, inorganic materials such as metal particles of copper, tin, aluminum, and indium; metal oxides such as silicon oxide, silica, tin oxide, zinc oxide, titanium oxide, indium oxide, antimony oxide, bismuth oxide, antimony doped tin oxide, and tin doped indium oxide; and potassium titanate. In the above-described examples of inorganic fine particles, particularly metal oxides work well. Further, silicon oxide, aluminum oxide, and titanium oxide may be effectively employed.

From a standpoint of abrasion resistance or light transmission rate of the surface layer 93 including the inorganic fine particles as shown in FIG. 13B to FIG. 13D, preferably an average primary particle diameter of the inorganic fine particles is in a range from 0.01 μm to 0.5 μm. When the average primary particle diameter of the inorganic fine particles is 0.01 μm or less, abrasion resistance declines and dispersibility declines. When the average primary particle diameter of the inorganic fine particles is 0.5 μm or more, settleability of the inorganic fine particles in a dispersion liquid is furthered and filming of the residue toner 11 may be generated.

The higher an addition amount of the inorganic fine particles in the outermost layer, the higher abrasion resistance of the outermost layer becomes. However, when the addition amount of the inorganic fine particles is too high, side effects of increase of residue potential and decline of writing light transmission rate of a protectant layer may be generated. Accordingly, the addition amount of the inorganic fine particles is 30% by weight or less with respect to an approximate total solid content, preferably 20% by weight or less. A lower limit value of the addition amount of the inorganic fine particles is normally 3% by weight.

The inorganic fine particles may be subjected to at least one type of surface treatment with a surface treatment agent. From a standpoint of dispersibility of the inorganic fine particles, preferably the inorganic fine particles are subjected to at least one type of surface treatment with the surface treatment agent.

Decline of dispersibility of the inorganic fine particles causes not only increase of residue potential but also decline of transparency of a coat, generates coating defects, and decline of abrasion resistance. Accordingly, decline of dispersibility of the inorganic fine particles may lead to problems preventing high durability and high image quality.

The following is a description of the drum shaped photoreceptor 10 in which the surface layer 93 having inorganic fine particles is provided as an outermost layer on the photosensitive layer 92 as shown in FIG. 13B to FIG. 13D.

The surface layer 93 is configured of at least inorganic fine particles and a binder resin. Specific examples of the inorganic fine particles include, but are not limited to, inorganic materials such as metal particles of copper, tin, aluminum, and indium; metal oxides such as silicon oxide, silica, tin oxide, zinc oxide, titanium oxide, indium oxide, antimony oxide, bismuth oxide, antimony doped tin oxide, and tin doped indium oxide; and potassium titanate. In the above-described examples of inorganic fine particles, particularly metal oxides work well. Further, silicon oxide, aluminum oxide, and titanium oxide may be effectively employed.

From a standpoint of abrasion resistance or light transmission rate of the surface layer 93 including the inorganic fine particles as shown in FIG. 13B to FIG. 13D, preferably an average primary particle diameter of the inorganic fine particles is in a range from 0.01 μm to 0.5 μm.

When the average primary particle diameter of the inorganic fine particles is 0.01 μm or less, abrasion resistance declines and dispersibility declines. When the average primary particle diameter of the inorganic fine particles is 0.5 μm or more, settleability of the inorganic fine particles in a dispersion liquid is furthered and filming of the residue toner 11 may be generated.

The higher a concentration of the inorganic fine particles in the surface layer 93, the higher abrasion resistance of the surface layer 93 becomes. However, when the addition amount of the inorganic fine particles is too high, side effects of increase of residue potential and decline of writing light transmission rate of a protectant layer may be generated.

Accordingly, the concentration of the inorganic fine particles is 50% by weight or less with respect to an approximate total solid content, preferably 30% by weight or less. A lower limit value of the concentration of the inorganic fine particles is normally 5% by weight.

The inorganic fine particles may be subjected to at least one type of surface treatment with a surface treatment agent. From a standpoint of dispersibility of the inorganic fine particles, preferably the inorganic fine particles are subjected to at least one type of surface treatment with the surface treatment agent.

Decline of dispersibility of the inorganic fine particles causes not only increase of residue potential but also decline of transparency of a coat, generates coating defects, and decline of abrasion resistance. Accordingly, decline of dispersibility of the inorganic fine particles may lead to problems preventing high durability and high image quality.

The surface treatment agent may be a conventionally employed surface treatment agent. Preferably, the surface treatment agent is able to maintain insulation properties of the inorganic fine particles.

Specific examples of the surface treatment agent include, but are not limited to, a titanate-based coupling agent, an aluminum-based coupling agent, a zircoaluminate-based coupling agent, a higher fatty acid, and a combination of the above-described coupling agents, the higher fatty acids and a silane coupling agent, or $Al_2O_3$, $TiO_2$, $ZrO_2$, silicone, aluminum stearate, and a combination of the above-described oxides, silicone, and aluminum stearate. From the standpoint of dispersibility of the inorganic fine particles and image blurring the above-described specific examples are preferable.

Treatment with a silane coupling agent strengthens an influence of image blurring. However, by making a combination of the above-described surface treatment agent and the silane coupling agent, the influence may be suppressed.

The amount of the surface treatment agent is different depending upon the average primary particle diameter of the inorganic fine particles. However, 3 wt % to 30 wt % is appropriate, preferably 5 wt % to 20 wt %. When the amount of the surface treatment agent is smaller than 3 wt %, dispersion effect of the inorganic fine particles is not obtained. When the amount of the surface treatment agent is larger than 30 wt %, residue potential substantially increases. The above-described inorganic materials of the inorganic fine particles may be used alone or in combination of two or more.

The above-described inorganic materials of the inorganic fine particles may be dispersed employing an appropriate disperser. From the standpoint of light transmission rate of the surface layer 93, an average particle diameter of the inorganic fine particles in a dispersion liquid is 1 μm or less, preferably 0.5 μm or less.

Next, a toner employed in the printer 100 according to an embodiment of the present invention is described below.

In the printer 100, a low temperature fixing toner having a glass transition temperature (Tg) in a range from 40° C. to 60° C. is employed to obtain energy saving in the fixing device 30 of the image forming apparatus.

To make the low temperature fixing toner according to an embodiment of the present invention obtain good low temperature fixing, hot offset resistance, and heat resistance storage stability, a polyester resin serving as a binder resin satisfying the following conditions is employed. The conditions are 1) a glass transition point (Tg) of 39° C. to 65° C., and 2) a value (Mw/Tg) of a weight average molecular weight (Mw) of tetrahydrofuran (THF) soluble component divided by a glass transition point (Tg/° C.) is 40 to 120.

In conventionally employed polyester resins, a tendency of a rapid decrease of the weight average molecular weight (Mw) is observed in accordance with decreasing the glass transition point (Tg) to lower than 65° C., and satisfying any one of low temperature fixing, hot offset resistance, and heat resistance storage stability is difficult. When the glass transition point (Tg) of the polyester resin is less than 39° C., heat resistance storage stability may not be improved by adjusting the weight average molecular weight (Mw). Therefore, a range in which physical properties of the low temperature fixing toner is balanced is the glass transition point (Tg) of 39° C. to 65° C. and the value (Mw/Tg) of the weight average molecular weight (Mw) of THF soluble component divided by the glass transition point (Tg/° C.) is 40 to 120. By making the value (Mw/Tg) of the weight average molecular weight (Mw) of THF soluble component divided by the glass transition point (Tg/° C.) have the above-described range, the polyester resin obtains the glass transition point (Tg) able to maintain heat resistance storage stability and low molecular weight is obtained. Accordingly, low temperature fixing of the low temperature fixing toner is further enhanced, and maintaining heat resistance storage stability is possible.

It is to be noted that the weight average molecular weight (Mw) and the glass transition point (Tg) is obtained with the following measurement method, and a unit of the glass transition point (Tg) in the value (Mw/Tg) of the weight average molecular weight (Mw) of THF soluble component divided by the glass transition point (Tg/° C.) is degrees (° C.).

The measurement of the glass transition point (Tg) is measured with Rigaku THERMOFLEX TG8110 (from Rigaku Corporation) at a condition of a temperature rising rate of 10° C./minute.

The measurement of a molecular weight is measured with gel permeation chromatography (GPC) as follows. In a heat chamber of 40° C., a column is stabilized. In the column at the temperature of 40° C., THF serving as a solvent is poured in the column at a flow rate of 1 ml per minute, a THF sample solution of 50 μl to 200 μl having a resin sample concentration adjusted to 0.05% by weight to 0.6% by weight is injected in the column, and measured. Regarding the measurement of a molecular weight of a sample, a molecular weight distribution of the sample is calculated from a relation of a count number and a logarithmic value of a calibration curve formed from several types of monodisperse polystyrene standard samples. Specific examples of the polystyrene standard samples for formation of the calibration curve, include but are not limited to, polystyrene standard samples (from Pressure Chemical Co. and Toyo Soda Manufacturing Co., Ltd.) having a molecular weight of 6×102, 2.1×103, 4×103, 1.75×104, 5.1×104, 1.1×105, 3.9×105, 8.6×105, 2×106, and 4.48×106. Employing at least around 10 of the polystyrene standard samples is appropriate. A refractive index (RI) detector is employed as a detector.

It is preferable that the polyester resin satisfying the above-described conditions have a chemical structure with the following characteristics. More specifically, the polyester resin including a molar ratio (hereinafter referred to as molar ratio of a benzene ring skeleton/a 1,4-cyclohexylene skeleton) of the benzene ring skeleton and the 1,4-cyclohexylene skeleton is 2.0 to 15.0, and a molar ratio (hereinafter referred to as molar ratio of a benzene skeleton/an alkylene skeleton having ester bonds at both ends) of the benzene skeleton and the alkylene skeleton having ester bonds at both ends is 3.0 or more.

The glass transition point (Tg) of the polyester resin is mainly governed by the chemical structure of the polyester resin. The more a sequence of the benzene ring skeleton and the more a content amount of the benzene ring skeleton, the glass transition point (Tg) tends to become higher. In addition, the longer the alkylene skeleton and the more a content amount of the alkylene skeleton, the glass transition point (Tg) tends to become lower. Accordingly, the more the content amount of the benzene ring skeleton, hot offset resistance and heat resistance storage stability are enhanced but low temperature fixability is disadvantageous. The more the content amount of the alkylene skeleton, low temperature fixability is advantageous but hot offset resistance and heat resistance storage stability are adversely influenced. On the other hand, by including an appropriate amount of the 1,4-cyclohexylene skeleton, adjustment of the weight average molecular weight (Mw) of the polyester resin while maintaining the glass transition point (Tg) is obtained and further enhancement of low temperature fixability is possible.

Accordingly, the molar ratio of the benzene ring skeleton/the 1,4-cyclohexylene skeleton and the molar ratio of the benzene skeleton/the alkylene skeleton having ester bonds at both ends are determined as the above-described range. When the molar ratio of the benzene ring skeleton/the 1,4-cyclohexylene skeleton is smaller than 2.0, the polyester resin becomes brittle and durability of the low temperature fixing toner is lost. When the molar ratio of the benzene ring skeleton/the 1,4-cyclohexylene skeleton is larger than 15.0, obtaining low molecular weight while maintaining the glass transition point (Tg) is difficult and low temperature fixability is not exhibited. In addition, when the molar ratio of the benzene skeleton/the alkylene skeleton having ester bonds at both ends is smaller than 3.0, maintaining heat resistance storage stability is difficult.

It is to be noted that the molar ratio of the benzene ring skeleton/the 1,4-cyclohexylene skeleton and the molar ratio of the benzene skeleton/the alkylene skeleton having ester bonds at both ends are calculated from a composition ratio of prepared polyvalent carboxylic acid and polyvalent alcohol serving as raw material of the polyester resin. The molar ratio of the benzene ring skeleton/the 1,4-cyclohexylene skeleton and the molar ratio of the benzene skeleton/the alkylene skeleton having ester bonds at both ends may be also calculated by 1H-NMR (nuclear magnetic resonance) measurement of the formed polyester resin.

To maintain heat resistance storage stability while having low temperature fixability and hot offset resistance, the weight average molecular weight (Mw) of the polyester resin is adjusted. The weight average molecular weight (Mw) of THF soluble component of the polyester resin according to an embodiment of the present invention is preferably designed to be 2000 to 7800. When the weight average molecular weight (Mw) is less than 2000, an oligomer component increases and heat resistance storage stability degrades even if control of the chemical structure is conducted as described above. When the weight average molecular weight (Mw) exceeds 7800, melting temperature becomes high and low temperature fixability degrades.

In addition, by making an acid value of the polyester resin in a range from 1.0 KOHmg/g to 50.0 KOHmg/g, properties of the low temperature fixing toner such as low temperature fixability, hot offset resistance, heat resistance storage stability, and charging stability may be made further high grade.

The low temperature fixing toner according to an embodiment of the present invention may be manufactured by employing the above-described polyester resin as the binder resin and mixing a polymer (hereinafter referred to as prepolymer) including a portion reactive to a compound having an active hydrogen group described in detail later. By mixing the compound having the active hydrogen group to the prepolymer, an elongation or crosslinking reaction is conducted in a process of manufacturing the low temperature fixing toner, and enhancement of the above-described properties of the low temperature fixing toner is obtained.

When the acid value of the polyester resin exceeds 50.0 KOHmg/g, the elongation or crosslinking reaction is insufficient and hot offset resistance is influenced. When the acid value of the polyester resin is less than 1.0 KOHmg/g, the elongation or crosslinking reaction easily progresses and a problem of manufacturing stability is generated.

It is to be noted that a measurement method of the acid value of the polyester resin is compliant with JIS K0070. However, when a sample does not melt, a solvent such as dioxane or THF is employed as the solvent.

In addition, an acid value of the low temperature fixing toner along with the acid value of the above-described polyester resin is significant with respect to low temperature fixability and hot offset resistance. Preferably, the acid value of the low temperature fixing toner is in a range from 0.5 KOHmg/g to 40.0 KOHmg/g. When the acid value of the low temperature fixing toner exceeds 40.0 KOHmg/g, the elongation or crosslinking reaction is insufficient and hot offset resistance is influenced. When the acid value of the low temperature fixing toner is less than 0.5 KOHmg/g, the elongation or crosslinking reaction easily progresses and a problem of manufacturing stability is generated. It is to be noted that a measurement of the acid value of the low temperature fixing toner may be conducted in the same manner as the measurement of the acid value of the polyester resin.

A glass transition point (Tg) of the low temperature fixing toner is preferably in a range from 40° C. to 60° C. to obtain low temperature fixability, heat resistance storage stability, and high durability. When the glass transition point (Tg) is less than 40° C., blocking of the low temperature fixing toner in the developing member or generation of filming on the drum shaped photoreceptor 10 tends to occur. When the glass transition point (Tg) exceeds 60° C., low temperature fixability degrades easier. It is to be noted that a measurement of the glass transition point (Tg) of the low temperature fixing toner may be conducted in the same manner as the measurement of the glass transition point (Tg) of the polyester resin.

Preferably, the low temperature fixing toner according to an embodiment of the present invention has a volume average particle diameter (Dv) in a range from 3 μm to 8 μm. Further, it is preferable that a ratio (Dv/Dn) of a number average particle diameter (Dn) and the volume average particle diameter (Dv) is in a range from 1.00 to 1.25. By determining the ratio (Dv/Dn) as described above, the low temperature fixing toner forming high resolution and high quality images may be obtained. In addition, to obtain further high quality images, determining the volume average particle diameter (Dv) in a range from 3 μm to 7 μm, the ratio (Dv/Dn) in a range from 1.00 to 1.20, and making a percent (%) by number of particles having less than 3 μm in a range from 1% by number to 10% by number is preferable. More preferably, the volume average particle diameter (Dv) is determined in a range from 3 μm to 6 μm and the ratio (Dv/Dn) is determined in a range from 1.00 to 1.15. The low temperature fixing toner having the above-described volume average particle diameter (Dv) and ratio (Dv/Dn) has good heat resistance storage stability, low temperature fixability, and hot offset resistance. Particularly, when the low temperature fixing toner having the above-described volume average particle diameter (Dv) and ratio (Dv/Dn) is employed in a full-color copying machine, good image gloss is obtained. Further, in a two-component developer, even when consumption and addition of the low temperature fixing toner is conducted over a long time period, fluctuation of particle diameter of the low temperature fixing toner in the developer becomes small. Accordingly, even when the low temperature fixing toner is agitated over a long time period in the developing device, good and stable developing is obtained.

An average particle diameter and a particle diameter distribution of the low temperature fixing toner is measured by employing a Coulter Counter Model TA-II (from Beckman Coulter Inc.) connected to an interface (from The Institute of JUSE) that outputs number distribution and volume distribution, and a personal computer (from NEC Corporation).

Next, examples of a low temperature fixing toner according to an embodiment of the present invention is described below.

Manufacturing Example 1

Example of Manufacturing a Polyester Resin

Materials of 517 parts of an adduct of bisphenol A with 2 moles of ethylene oxide, 317 parts of terephthalic acid, 101 parts of ethylene glycol, and 65 parts of hydrogenated bisphenol A are put in a reaction vessel including a cooling pipe, a stirrer, and a nitrogen inlet pipe. Under normal pressure nitrogen gas flow, a condensation reaction for ten hours at 170° C. is conducted. Then the condensation reaction is continued for five hours at a reaction temperature of 210° C. Further, the condensation reaction is continued for five hours while dehydrating under reduced pressure in a range from 0 mmHg to 15 mmHg. Then the reacted materials are cooled. A polyester resin PE1 of manufacturing example 1 is prepared. The prepared polyester resin PE1 exhibited a weight average molecular weight (Mw) of THF soluble component of 2900, an acid value of 5 KOHmg/g, and a glass transition point (Tg) of 43° C. A ratio (Mw/Tg) of a weight average molecular weight (Mw) divided by a glass transition point (Tg) is 67. Further, a molar ratio of a benzene ring skeleton and a 1,4-cyclohexylene skeleton is 9.5 and a molar ratio of a benzene ring skeleton and an alkylene skeleton having ester bonds at both ends is 3.2.

Example of Manufacturing a Prepolymer

Materials of 795 parts of an adduct of bisphenol A with 2 moles of ethylene oxide, 200 parts of isophthalic acid, 65 parts of terephthalic acid, and 2 parts of dibutyltin oxide are put in a reaction vessel including a cooling pipe, a stirrer, and a nitrogen inlet pipe. Under normal pressure nitrogen gas flow, a condensation reaction for eight hours at 210° C. is conducted. Next, the condensation reaction is continued for five hours while dehydrating under reduced pressure in a range from 10 mmHg to 15 mmHg. Then the reacted materials are cooled to 80° C. Then the reacted materials are reacted with 170 parts of isophorone diisocyanate in ethyl acetate. A prepolymer a1 of manufacturing example 1 is prepared. The prepared prepolymer a1 exhibited a weight average molecular weight (Mw) of THF soluble component of 5000, and an average functional group number is 2.25.

Example of Manufacturing a Ketimine Compound

Materials of 30 parts of isophorone diamine and 70 parts of methyl ethyl ketone are put in a reaction vessel including a stirring rod and a thermometer. The materials are reacted for five hours at 50° C. A ketimine compound b1 of manufacturing example 1 is prepared.

Example of Manufacturing a Toner

Materials of 85 parts of the polyester resin PE1, 15 parts of the prepolymer a1, 2 parts of the ketimine compound b1, 5 parts of free fatty acid eliminated type carnauba wax, 10 parts of carbon black (#44, from Mitsubishi Chemical Corporation), 1 part of an azo compound including a metal, and 5 parts of water are stirred and mixed with a Henschel mixer. Then, the stirred and mixed materials are heated and melted for a time period of around thirty minutes at a temperature in a range from 130° C. to 140° C. with a roll mill, and cooled to room temperature. An obtained kneaded mixture is crushed and classified employing a jet mill and a pneumatic separator. A toner base of manufacturing example 1 is prepared. 0.5 parts of hydrophobic silica is added and mixed to the prepared toner base of manufacturing example 1. A toner I is prepared.

Manufacturing Example 2

Example of Manufacturing a Polyester Resin

Materials of 613 parts of an adduct of bisphenol A with 2 moles of ethylene oxide, 322 parts of terephthalic acid, 13 parts of ethylene glycol, and 52 parts of hydrogenated bisphenol A are put in a reaction vessel including a cooling pipe, a stirrer, and a nitrogen inlet pipe. The example of manufacturing a polyester resin of manufacturing example 1 is repeated except for replacing the materials of the example of manufacturing a polyester resin of manufacturing example 1 with the materials of the example of manufacturing a polyester resin of manufacturing example 2. A polyester resin PE2 of manufacturing example 2 is prepared. The prepared polyester resin PE2 exhibited a weight average molecular weight (Mw) of THF soluble component of 5800, an acid value of 38 KOHmg/g, and a glass transition point (Tg) of 59° C. A ratio (Mw/Tg) of a weight average molecular weight (Mw) divided by a glass transition point (Tg) is 98. Further, a molar ratio of a benzene ring skeleton and a 1,4-cyclohexylene skeleton is 13.5 and a molar ratio of a benzene ring skeleton and an alkylene skeleton having ester bonds at both ends is 27.0.

Example of Manufacturing a Toner

Materials of 85 parts of the polyester resin PE2, 15 parts of the prepolymer a1, 2 parts of the ketimine compound b1, 5 parts of free fatty acid eliminated type carnauba wax, 10 parts of carbon black (#44, from Mitsubishi Chemical Corporation), 1 part of an azo compound including a metal, and 5 parts of water are stirred and mixed with a Henschel mixer. Then, the stirred and mixed materials are heated and melted for a time period of around thirty minutes at a temperature in a range from 130° C. to 140° C. with a roll mill, and cooled to room temperature. An obtained kneaded mixture is crushed and classified employing a jet mill and a pneumatic separator. A toner base of manufacturing example 2 is prepared. 0.5 parts of hydrophobic silica is added and mixed to the prepared toner base of manufacturing example 2. A toner II is prepared.

Manufacturing Example 3

Example of Manufacturing a Polyester Resin

Materials of 548 parts of an adduct of bisphenol A with 2 moles of ethylene oxide, 296 parts of terephthalic acid, 44 parts of ethylene glycol, and 113 parts of hydrogenated bisphenol A are put in a reaction vessel including a cooling pipe, a stirrer, and a nitrogen inlet pipe. The example of manufacturing a polyester resin of manufacturing example 1 is repeated except for replacing the materials of the example of manufacturing a polyester resin of manufacturing example 1 with the materials of the example of manufacturing a polyester resin of manufacturing example 3. A polyester resin PE3 of manufacturing example 3 is prepared. The prepared polyester resin PE3 exhibited a weight average molecular weight (Mw) of THF soluble component of 3300, an acid value of 7 KOHmg/g, and a glass transition point (Tg) of 43° C. A ratio (Mw/Tg) of a weight average molecular weight (Mw) divided by a glass transition point (Tg) is 77. Further, a molar ratio of a benzene ring skeleton and a 1,4-cyclohexylene skeleton is 5.6 and a molar ratio of a benzene ring skeleton and an alkylene skeleton having ester bonds at both ends is 7.5.

Example of Manufacturing a Toner

Materials of 83 parts of the polyester resin PE3, 17 parts of the prepolymer a1, 2 parts of the ketimine compound b1, 5 parts of free fatty acid eliminated type carnauba wax, 10 parts of carbon black (#44, from Mitsubishi Chemical Corporation), 1 part of an azo compound including a metal, and 5 parts of water are stirred and mixed with a Henschel mixer. Then, the stirred and mixed materials are heated and melted for a time period of around thirty minutes at a temperature in a range from 130° C. to 140° C. with a roll mill, and cooled to room temperature. An obtained kneaded mixture is crushed and classified employing a jet mill and a pneumatic separator. A toner base of manufacturing example 3 is prepared. 0.5 parts of hydrophobic silica is added and mixed to the prepared toner base of manufacturing example 3. A toner III is prepared.

Manufacturing Example 4

Example of Manufacturing a Polyester Resin

Materials of 426 parts of an adduct of bisphenol A with 2 moles of ethylene oxide, 350 parts of terephthalic acid, 8 parts of ethylene glycol, and 216 parts of hydrogenated bisphenol A are put in a reaction vessel including a cooling pipe, a stirrer, and a nitrogen inlet pipe. The example of manufacturing a polyester resin of manufacturing example 1 is repeated except for replacing the materials of the example of manufacturing a polyester resin of manufacturing example 1 with the materials of the example of manufacturing a polyester resin of manufacturing example 4. A polyester resin PE4 of manufacturing example 4 is prepared. The prepared polyester resin PE4 exhibited a weight average molecular weight (Mw) of THF soluble component of 6500, an acid value of 28 KOHmg/g, and a glass transition point (Tg) of 62° C. A ratio (Mw/Tg) of a weight average molecular weight (Mw) divided by a glass transition point (Tg) is 105. Further, a molar ratio of a benzene ring skeleton and a 1,4-cyclohexylene skeleton is 2.7 and a molar ratio of a benzene ring skeleton and an alkylene skeleton having ester bonds at both ends is 35.7.

Example of Manufacturing a Prepolymer

Materials of 795 parts of an adduct of bisphenol A with 2 moles of ethylene oxide, 200 parts of isophthalic acid, 65 parts of terephthalic acid, and 2 parts of dibutyltin oxide are put in a reaction vessel including a cooling pipe, a stirrer, and a nitrogen inlet pipe. Under normal pressure nitrogen gas flow, a condensation reaction for eight hours at 210° C. is conducted. Next, the condensation reaction is continued for five hours while dehydrating under reduced pressure in a range from 10 mmHg to 15 mmHg. Then the reacted materials are cooled to 80° C. Then the reacted materials are reacted with 150 parts of isophorone diisocyanate in ethyl acetate for two hours. A prepolymer a2 of manufacturing example 4 is prepared. The prepared prepolymer a2 exhibited a weight average molecular weight (Mw) of THF soluble component of 5000, and an average functional group number is 2.00.

Example of Manufacturing a Toner

Materials of 14.3 parts of the prepolymer a2, 55 parts of the polyester resin PE4, and 78.6 parts of ethyl acetate are put in a beaker, and stirred and melted. Next, separate from the above-described materials, materials of 10 parts of rice wax serving as a release agent, 4 parts of copper phthalocyanine blue pigment, and 100 parts of ethyl acetate are put in a bead mill and dispersed for thirty minutes. The stirred and melted materials and the separate dispersed materials are mixed. An obtained mixed material is stirred for five minutes at a number of revolutions of 12000 rpm employing a T.K. homo mixer. Then, the obtained mixed material is subjected to a dispersion treatment with the bead mill for ten minutes. A toner material oil dispersion liquid 1 is prepared.

Materials of 306 parts of an ion exchange water, 265 parts of tricalcium phosphate 10% suspension liquid, and 0.2 parts of sodium dodecylbenzenesulfonate are put in a beaker to form a water dispersion liquid. Next, the above-described toner material oil dispersion liquid 1 and 2.7 parts of the ketimine compound b1 are added to the water dispersion liquid while the water dispersion liquid is stirred with a T.K. homo mixer at 12000 rpm. An obtained mixture of the toner material oil dispersion liquid 1, the ketimine compound b1, and the water dispersion liquid is reacted by continuous mixing for a time period of thirty minutes. Then, an organic solvent is removed from the obtained mixture (viscosity: 5500 mPa·s) after reaction under a reduced pressure within 1.0 hour at a temperature of 50° C. or less. Then, the obtained mixture after reaction with the organic solvent removed is subjected to filtration, cleaning, drying, and pneumatically separated and classified. A spherical shaped toner base of manufacturing example 4 is prepared.

Materials of 100 parts of the obtained spherical shaped toner base of manufacturing example 4 and 0.25 parts of a charge control agent (Bontron E-84, from Orient Chemical Industries, Co., Ltd.) are put in a Q type mixer (from Mitsui Mining Co., Ltd.) and mixed at a setting in which circumferential speed of a turbine type blade is 50 msec. Mixing operation is five cycles of a run time of two minutes and a stop time of one minute. Total process time is ten minutes. Further, 0.5 parts of hydrophobic silica (H2000, Clariant Japan) is added to an obtained mixture of the spherical shaped toner base of manufacturing example 4 and the charge control agent, and mixed. Circumferential speed of the turbine type blade is set to 15 msec. Mixing operation is five cycles of a run time of thirty seconds and a stop time of one minute. A toner IV is prepared.

Physical properties of the above-described polyester resins PE1 to PE4 employed in the above-described toners I to IV are shown in Table 3.

TABLE 3

| Polyester resin | Weight average molecular weight (Mw) | Acid value (KOHmg/g) | Glass transition point (Tg) (° C.) | Mw/Tg | benzene ring skeleton/ 1,4-cyclohexylene skeleton | benzene ring skeleton/ alkylene skeleton having ester bonds at both ends |
|---|---|---|---|---|---|---|
| PE1 | 2900 | 5 | 43 | 67 | 9.5 | 3.2 |
| PE2 | 5800 | 38 | 59 | 98 | 13.5 | 27.0 |
| PE3 | 3300 | 7 | 43 | 77 | 5.6 | 7.5 |
| PE4 | 6500 | 28 | 62 | 105 | 2.7 | 35.7 |

Manufacturing Example 5

Example of Manufacturing a Polyester Resin

Materials of 585 parts of an adduct of bisphenol A with 2 moles of ethylene oxide, 307 parts of terephthalic acid, 71 parts of ethylene glycol, and 36 parts of hydrogenated bisphenol A are put in a reaction vessel including a cooling pipe, a stirrer, and a nitrogen inlet pipe. The example of manufacturing a polyester resin of manufacturing example 1 is repeated except for replacing the materials of the example of manufacturing a polyester resin of manufacturing example 1 with the materials of the example of manufacturing a polyester resin of manufacturing example 5. A polyester resin PE5 of manufacturing example 5 is prepared. The prepared polyester resin PE5 exhibited a weight average molecular weight (Mw) of THF soluble component of 2500, an acid value of 9 KOHmg/g, and a glass transition point (Tg) of 35° C. A ratio (Mw/Tg) of a weight average molecular weight (Mw) divided by a glass transition point (Tg) is 71. Further, a molar ratio of a benzene ring skeleton and a 1,4-cyclohexylene skeleton is 18.5 and a molar ratio of a benzene ring skeleton and an alkylene skeleton having ester bonds at both ends is 4.8.

Example of Manufacturing a Toner

Materials of 85 parts of the polyester resin PE5, 15 parts of the prepolymer a1, 2 parts of the ketimine compound b1, 5 parts of free fatty acid eliminated type carnauba wax, 10 parts of carbon black (#44, from Mitsubishi Chemical Corporation), 1 part of an azo compound including a metal, and 5 parts of water are stirred and mixed with a Henschel mixer. Then, the stirred and mixed materials are heated and melted for a time period of around thirty minutes at a temperature in a range from 130° C. to 140° C. with a roll mill, and cooled to room temperature. An obtained kneaded mixture is crushed and classified employing a jet mill and a pneumatic separator. A toner base of manufacturing example 5 is prepared. 0.5 parts of hydrophobic silica is added and mixed to the prepared toner base of manufacturing example 5. A toner V is prepared.

Manufacturing Example 6

Example of Manufacturing a Polyester Resin

Materials of 244 parts of an adduct of bisphenol A with 2 moles of ethylene oxide, 443 parts of terephthalic acid, 99 parts of ethylene glycol, and 214 parts of hydrogenated bisphenol A are put in a reaction vessel including a cooling pipe, a stirrer, and a nitrogen inlet pipe. The example of manufacturing a polyester resin of manufacturing example 1 is repeated except for replacing the materials of the example of manufacturing a polyester resin of manufacturing example 1 with the materials of the example of manufacturing a polyester resin of manufacturing example 6. A polyester resin PE6 of manufacturing example 6 is prepared. The prepared polyester resin PE6 exhibited a weight average molecular weight (Mw) of THF soluble component of 5700, an acid value of 18 KOHmg/g, and a glass transition point (Tg) of 45° C. A ratio (Mw/Tg) of a weight average molecular weight (Mw) divided by a glass transition point (Tg) is 127. Further, a molar ratio of a benzene ring skeleton and a 1,4-cyclohexylene skeleton is 2.4 and a molar ratio of a benzene ring skeleton and an alkylene skeleton having ester bonds at both ends is 2.6.

Example of Manufacturing a Toner

Materials of 14.3 parts of the prepolymer a1, 55 parts of the polyester resin PE6, and 78.6 parts of ethyl acetate are put in a beaker, and stirred and melted. Next, separate from the above-described materials, materials of 10 parts of rice wax serving as a release agent, 4 parts of copper phthalocyanine blue pigment, and 100 parts of ethyl acetate are put in a bead mill and dispersed for thirty minutes. The stirred and melted materials and the separate dispersed materials are mixed. An obtained mixed material is stirred for five minutes at a number of revolutions of 12000 rpm employing a T.K. homo mixer. Then, the obtained mixed material is subjected to a dispersion treatment with the bead mill for ten minutes. A toner material oil dispersion liquid 2 is prepared.

Materials of 306 parts of an ion exchange water, 265 parts of tricalcium phosphate 10% suspension liquid, and 0.2 parts of sodium dodecylbenzenesulfonate are put in a beaker to form a water dispersion liquid. Next, the above-described toner material oil dispersion liquid 2 and 2.7 parts of the ketimine compound b1 are added to the water dispersion liquid while the water dispersion liquid is stirred with a T.K. homo mixer at 12000 rpm. An obtained mixture of the toner material oil dispersion liquid 2, the ketimine compound b1, and the water dispersion liquid is reacted by continuous mixing for a time period of thirty minutes. Then, an organic solvent is removed from the obtained mixture (viscosity: 3800 mPa·s) after reaction under a reduced pressure within 1.0 hour at a temperature of 50° C. or less. Then, the obtained mixture after reaction with the organic solvent removed is subjected to filtration, cleaning, drying, and pneumatically separated and classified. A spherical shaped toner base of manufacturing example 6 is prepared.

Materials of 100 parts of the obtained spherical shaped toner base of manufacturing example 6 and 0.25 parts of a charge control agent (Bontron E-84, from Orient Chemical Industries, Co., Ltd.) are put in a Q type mixer (from Mitsui Mining Co., Ltd.) and mixed at a setting in which circumferential speed of a turbine type blade is 50 m/sec. Mixing operation is five cycles of a run time of two minutes and a stop time of one minute. Total process time is ten minutes. Further, 0.5 parts of hydrophobic silica (H2000, Clariant Japan) is added to an obtained mixture of the spherical shaped toner base of manufacturing example 6 and the charge control agent, and mixed. Circumferential speed of the turbine type blade is set to 15 msec. Mixing operation is five cycles of a run time of thirty seconds and a stop time of one minute. A toner VI is prepared.

Manufacturing Example 7

Example of Manufacturing a Polyester Resin

Materials of 393 parts of an adduct of bisphenol A with 2 moles of ethylene oxide, 430 parts of terephthalic acid, 121 parts of ethylene glycol, and 57 parts of hydrogenated bisphenol A are put in a reaction vessel including a cooling pipe, a stirrer, and a nitrogen inlet pipe. The example of manufacturing a polyester resin of manufacturing example 1 is repeated except for replacing the materials of the example of manufacturing a polyester resin of manufacturing example 1 with the materials of the example of manufacturing a polyester resin of manufacturing example 7. A polyester resin PE7 of manufacturing example 7 is prepared. The prepared polyester resin PE7 exhibited a weight average molecular weight (Mw) of THF soluble component of 5000, an acid value of 11 KOHmg/g, and a glass transition point (Tg) of 41° C. A ratio (Mw/Tg) of a weight average molecular weight (Mw) divided by a glass transition point (Tg) is 122. Further, a molar ratio of a benzene ring skeleton and a 1,4-cyclohexylene skeleton is 10.8 and a molar ratio of a benzene ring skeleton and an alkylene skeleton having ester bonds at both ends is 2.6.

Example of Manufacturing a Toner

Materials of 14.3 parts of the prepolymer a2, 55 parts of the polyester resin PE7, and 78.6 parts of ethyl acetate are put in a beaker, and stirred and melted. Next, separate from the above-described materials, materials of 10 parts of rice wax serving as a release agent, 4 parts of copper phthalocyanine blue pigment, and 100 parts of ethyl acetate are put in a bead mill and dispersed for thirty minutes. The stirred and melted materials and the separate dispersed materials are mixed. An obtained mixed material is stirred for five minutes at a number of revolutions of 12000 rpm employing a T.K. homo mixer. Then, the obtained mixed material is subjected to a dispersion treatment with the bead mill for ten minutes. A toner material oil dispersion liquid 3 is prepared.

Materials of 306 parts of an ion exchange water, 265 parts of tricalcium phosphate 10% suspension liquid, and 0.2 parts of sodium dodecylbenzenesulfonate are put in a beaker to form a water dispersion liquid. Next, the above-described toner material oil dispersion liquid 3 and 2.7 parts of the ketimine compound b1 are added to the water dispersion liquid while the water dispersion liquid is stirred with a T.K. homo mixer at 12000 rpm. An obtained mixture of the toner material oil dispersion liquid 3, the ketimine compound b1, and the water dispersion liquid is reacted by continuous mixing for a time period of thirty minutes. Then, an organic solvent is removed from the obtained mixture (viscosity: 7800 mPa·s) after reaction under a reduced pressure within 1.0 hour at a temperature of 50° C. or less. Then, the obtained mixture after reaction with the organic solvent removed is subjected to filtration, cleaning, drying, and pneumatically separated and classified. A spherical shaped toner base of manufacturing example 7 is prepared.

Materials of 100 parts of the obtained spherical shaped toner base of manufacturing example 7 and 0.25 parts of a charge control agent (Bontron E-84, from Orient Chemical Industries, Co., Ltd.) are put in a Q type mixer (from Mitsui Mining Co., Ltd.) and mixed at a setting in which circumferential speed of a turbine type blade is 50 msec. Mixing operation is five cycles of a run time of two minutes and a stop time of one minute. Total process time is ten minutes. Further, 0.5 parts of hydrophobic silica (H2000, Clariant Japan) is added to an obtained mixture of the spherical shaped toner base of manufacturing example 7 and the charge control agent, and mixed. Circumferential speed of the turbine type blade is set to 15 msec. Mixing operation is five cycles of a run time of thirty seconds and a stop time of one minute. A toner VII is prepared.

Physical properties of the above-described polyester resins PE5 to PE7 employed in the above-described toners V to VII are shown in Table 4.

TABLE 4

| Polyester resin | Weight average molecular weight (Mw) | Acid value (KOHmg/g) | Glass transition point (Tg) (° C.) | Mw/Tg | benzene ring skeleton/ 1,4-cyclohexylene skeleton | benzene ring skeleton/ alkylene skeleton having ester bonds at both ends |
|---|---|---|---|---|---|---|
| PE5 | 2500 | 9 | 35 | 71 | 18.5 | 4.8 |
| PE6 | 5700 | 18 | 45 | 127 | 2.4 | 2.6 |
| PE7 | 5000 | 11 | 41 | 122 | 10.8 | 2.6 |

By employing the above-described toners I to VII as examples of the low temperature fixing toner according to an embodiment of the present invention, low temperature fixability, hot offset resistance, and heat resistance storage stability are evaluated. Evaluation items and evaluation method of the toners I to VII are as follows.

Fixability Evaluation

A modified fixing device employing a Teflon (registered trademark) roller as a fixing roller of a fixing member in a MF2000 copier (from Ricoh Company) is used. 6200 type sheets (from Ricoh Company) are set in the MF2000 copier (from Ricoh Company) and copying tests are conducted. A cold offset temperature (i.e., fixing lower limit temperature) and a hot offset temperature (i.e., hot offset resistance temperature) are determined by changing fixing temperature. The fixing lower limit temperature of conventional low temperature fixing toners are in a range from around 140° C. to 150° C. The evaluation conditions of the low temperature fixability are as follows. Linear velocity is 120 mm/sec to 150 mm/sec, surface pressure is 1.2 kgf/cm$^2$, and nip width is 3 mm. The evaluation conditions of the hot offset resistance are set as follows. Linear velocity is 50 mm/sec, surface pressure is 2.0 kgf/cm$^2$, and nip width is 4.5 mm.

Evaluation criterion of each property evaluation is as follows.

1) Low Temperature Fixability (Five Grade Evaluation)
Excellent: less than 130° C., Good: 130° C. to 140° C., Average: 140° C. to 150° C., Fair: 150° C. to 160° C., Poor: 160° C. or more 2) Hot Offset Resistance (Five Grade Evaluation)
Excellent: 201° C. or more, Good: 200° C. to 191° C., Average: 190° C. to 181° C., Fair: 180° C. to 171° C., Poor: 170° C. or less Heat Resistance Storage Stability Evaluation A 20 g sample of each of the toners I to VII is put in respective 20 ml glass bottles. Each of the glass bottles is tapped around fifty times to compact each of the samples. After compacting, each of the glass bottles is left for twenty-four hours in a high temperature vessel at a temperature of 50° C. Then, by employing a penetration tester, penetrability is evaluated as follows.

3) Heat Resistance Storage Stability (Five Grade Evaluation)
Excellent: Penetrated, Good: penetrability to 25 mm, Average: 25 mm to 20 mm, Fair: 20 mm to 15 mm, Poor: 15 mm or less The evaluation results of the toners I to VII are shown in Table 5.

TABLE 5

| Toner | Acid value (KOH mg/g) | Glass transition point (Tg) (° C.) | Volume average particle diameter (Dv) (μm) | Dv/Dn | Average circularity | BET Specific surface area (m$^2$/g) | Low temperature fixability | Hot offset resistance | Heat resistance storage stability |
|---|---|---|---|---|---|---|---|---|---|
| I | 4 | 45 | 6.7 | 1.05 | 0.92 | 5.9 | Excellent | Excellent | Good |
| II | 28 | 59 | 5.9 | 1.10 | 0.93 | 5.2 | Good | Good | Excellent |
| III | 6 | 43 | 7.0 | 1.07 | 0.98 | 5.3 | Excellent | Excellent | Good |
| IV | 23 | 61 | 4.7 | 1.15 | 0.98 | 1.5 | Good | Good | Excellent |
| V | 8 | 38 | 5.5 | 1.08 | 0.93 | 5.5 | Excellent | Good | Poor |
| VI | 16 | 46 | 5.8 | 1.10 | 0.95 | 5.0 | Good | Excellent | Average |
| VII | 10 | 43 | 3.2 | 1.22 | 0.98 | 1.9 | Good | Good | Fair |

It is understood from Table 5 that a result of good low temperature fixability, hot offset resistance, and heat resistance storage stability are obtained by the toners I to IV, toner VI, and toner VII having a glass transition point (Tg) in a range from 40° C. to 61° C. On the other hand, a result of good low temperature fixability and hot offset resistance but poor heat resistance storage stability are obtained by the toner V having a glass transition point (Tg) of less than 40° C. The toner V exhibits inferior heat resistance storage stability. Accordingly, it is confirmed that toners having at least the glass transition point (Tg) in a range from 40° C. to 61° C. obtain good low temperature fixability, hot offset resistance, and heat resistance storage stability.

The description thus far is one example of an embodiment of the present invention. Each aspect of the present invention exhibit particular effects as follows.

Aspect A

The cleaning blade 5 includes the blade member formed of the strip-shaped rubber material. The leading-edge ridge line portion 61 (hereinafter referred to as edge portion 61) contacts a moving surface of the cleaning target member such as the drum shaped photoreceptor 10 and removes adhering matter from the surface of the cleaning target member. The blade member has a Martens hardness of 1.0 N/mm$^2$ or more in the vicinity of the leading-edge ridge line portion 61 measured from the opposing surface 62 of the blade member, the opposing surface 62 including the leading-edge ridge line portion 61 and opposing the cleaning target member, or measured from the leading-edge surface 63 of the blade member, the leading-edge surface 63 including the leading-edge ridge line portion 61 and disposed adjacent to the opposing surface 62 of the blade member.

Accordingly, as described in the experiment of the above-described embodiments of the blade member, when the Martens hardness of the vicinity of the leading-edge ridge line portion 61 of the blade member formed of the rubber material is 1.0 N/mm$^2$ or more, the generation of filming on the surface of the drum shaped photoreceptor 10 may be suppressed even when particles such as the low temperature fixing toner are employed to obtain energy saving. The generation of filming is suppressed due to suppression of deformation of the leading-edge ridge line portion 61. Suppression of deformation of the leading-edge ridge line portion 61 makes slipping through of the residue toner difficult, and the residue toner is not pressed against the surface of the drum shaped photoreceptor 10. In addition, due to suppressing the enlargement of the contact surface area of the leading-edge ridge line portion 61, the sliding friction force between the surface of the drum shaped photoreceptor 10 and the leading-edge ridge line portion 61 is suppressed, and the generation of friction heat is suppressed. Accordingly, temperature increase of the leading-edge ridge line portion 61 is suppressed.

As an index of representing hardness of around the leading-edge ridge line portion 61 of the blade member formed of the rubber material, Martens hardness is employed instead of the common widely employed JIS-A measurement method to measure hardness of the rubber material. Martens hardness is a property of a measured minute region of the leading-edge ridge line portion 61 employing a microhardness measurement instrument and no influence of regions other than the leading-edge ridge line portion 61 is included as in a rubber hardness with the JIS-A measurement method in which the rubber hardness is influenced by regions other than the leading-edge ridge line portion 61 depending on position of hardness measurement. In other words, Martens hardness is appropriate in defining hardness and deformation amount of only the leading-edge ridge line portion 61 irrespective to position of hardness measurement. Accordingly, the cleaning blade 5 having good suppression of generation of filming on the surface of the drum shaped photoreceptor 10 may be provided by making the Martens hardness 1.0 N/mm$^2$ or more around the leading-edge ridge line portion 61 of the blade member measured from either the opposing surface 62 or the leading-edge surface 63.

Aspect B

The cleaning blade 5 according to aspect A in which the blade member has the laminated structure including the edge layer 6 including the leading-edge ridge line portion 61 and at least one layer or more of the backup layer 7 laminated on the edge layer 6. A Martens hardness of the edge layer 6 in the vicinity of the leading-edge ridge line portion 61 measured from the opposing surface 62 or the leading-edge surface 63 of the blade member is different from a Martens hardness of a layer other than the edge layer 6 measured from the leading-edge surface 63 of the blade member.

Accordingly, deformation of the leading-edge ridge line portion 61 and around the leading-edge ridge line portion 61 may be reduced by making the leading-edge ridge line portion 61 hard, and hardness of the rubber material of the backup layer 7 may be selected. Thus, properties of the cleaning blade 5 as a whole may be adjusted.

Aspect C

The cleaning blade 5 according to aspect A in which the blade member has the laminated structure including the edge layer 6 including the leading-edge ridge line portion 61 and at least one layer or more of the backup layer 7 laminated on the edge layer 6. A Martens hardness of the layer other than the edge layer 6 measured from the leading-edge surface 63 or the back surface 71 of the blade member opposite the opposing surface 62 of the blade member is smaller than a Martens hardness of the edge layer 6 in the vicinity of the leading-edge ridge line portion 61 measured from the opposing surface 62 or the leading-edge surface 63 of the blade member. Accordingly, deformation of the leading-edge ridge line portion 61 and the vicinity of the leading-edge ridge line portion 61 may be reduced by making the leading-edge ridge line portion 61 hard. Fatigue over time may be suppressed by making a hardness of the backup layer 7 small. Thus, contact pressure is stabilized when employing the cleaning blade 5 over a long time period, and the cleaning blade 5 obtains stable properties over the long time period. In addition, the measurement value of the Martens hardness is not influenced by other layers in the laminated structure due to position of hardness measurement. Accordingly, a Martens hardness measured from the leading-edge surface 63 or a Martens hardness measured from the back surface 71 may be employed as a hardness of the backup layer 7.

Aspect D

The cleaning blade 5 according to aspect A in which the vicinity of the leading-edge ridge line portion 61, each of the opposing surface 62 and the leading-edge surface 63 includes the first rubber material having a Martens hardness different from a Martens hardness of the second rubber material forming an area other than the vicinity of the leading-edge ridge line portion 61. Accordingly, deformation of the leading-edge ridge line portion 61 and the vicinity of the leading-edge ridge line portion 61 may be reduced by making the leading-edge ridge line portion 61 hard, and properties of the cleaning blade 5 as a whole may be adjusted.

Aspect E

The cleaning blade 5 according to any one of aspect A to aspect D in which the opposing surface 62 and the leading-edge surface 63 contact the surface of the cleaning target member such as the drum shaped photoreceptor 10 when the blade member is in contact with the surface of the cleaning target member. Accordingly, in the state in which the leading-edge ridge line portion 61 contacts, deformation of the leading-edge ridge line portion 61 is small and the contact surface area between the leading-edge ridge line portion 61 and the surface of the drum shaped photoreceptor 10 does not become enlarged. Accordingly, the contact pressure to the surface of the drum shaped photoreceptor 10 becomes high and slipping through of the residue toner adhering to the surface of the drum shaped photoreceptor 10 is prevented. Thus, the generation of filming on the surface of the drum shaped photoreceptor 10 and the generation of cleaning failure may be favorably suppressed.

Aspect F

The cleaning blade 5 according to any one of aspect A to aspect E in which at least a 100% modulus value at 23° C. of a material forming the leading-edge ridge line portion 61 of the blade member is in a range from 6 Mpa to 12 Mpa.

Aspect G

The cleaning blade 5 according to any one of aspect A to aspect F in which the rubber material forming the blade member has a tan δ peak temperature of less than 10° C. Accordingly, the rubber material of the blade member functions as the rubber material even under the low temperature environment such as an environment temperature of 10° C. Thus, the cleaning blade 5 functions as the rubber material having elasticity even under a conceivable low temperature environment in a typical office, and good cleaning performance may be obtained due to the cleaning blade 5 having elasticity and contacting the surface of the drum shaped photoreceptor 10.

Aspect H

The image forming apparatus including an image carrier such as the drum shape photoreceptor 10 serving as a surface moving member to bear an image on a surface thereof, the image of a low temperature fixing toner having a low glass transition temperature (Tg) and transferred from the image carrier to a recording medium; and the cleaning blade 5 according to any one of aspect A to aspect G to contact the surface of the image carrier to remove the toner adhering to the surface of the image carrier. The cleaning blade 5 including the blade member formed of the strip-shaped rubber material and having the leading-edge ridge line portion 61 to contact the surface of the image carrier and remove toner adhering to the surface of the image carrier. The blade member has a Martens hardness of 1.0 N/mm$^2$ or more in the vicinity of the leading-edge ridge line portion 61 measured from the opposing surface 62 of the blade member, the opposing surface 62 including the leading-edge ridge line portion 61 and opposing the image carrier, or measured from the leading-edge surface 63 of the blade member, the leading-edge surface 63 including the leading-edge ridge line portion 61 and disposed adjacent to the opposing surface 62 of the blade member. Accordingly, as described in the above-described embodiments, the generation of filming on the surface of the drum shaped photoreceptor 10 and the generation of cleaning failure may be favorably suppressed even when employing the low temperature fixing toner, and high quality images may be obtained.

Aspect I

The image forming apparatus according to aspect H in which the surface of the image carrier includes inorganic fine particles. Accordingly, the generation of filming on the surface of the drum shaped photoreceptor 10 and the generation of cleaning failure may be favorably suppressed while enhancing abrasion resistance of the surface of the drum shaped photoreceptor.

Aspect J

The image forming apparatus according to aspect H further including the protectant coating device 70 that coats the protectant 12 on the surface of the image carrier. Accordingly, the sliding friction force between the surface of the drum shaped photoreceptor 10 and the leading-edge ridge line portion 61 of the cleaning blade 5 is suppressed and the generation of filming on the surface of the drum shaped photoreceptor 10 and the generation of cleaning failure are favorably suppressed.

Aspect K

The image forming apparatus according to aspect H in which the toner contains an additive including a fatty acid metal salt. Accordingly, the generation of filming on the surface of the drum shaped photoreceptor 10 and the generation of cleaning failure are favorably suppressed while enhancing abrasion resistance of the surface of the drum shaped photoreceptor.

Aspect L

The process cartridge including an image carrier such as the drum shaped photoreceptor 10 to bear a toner image on a surface thereof; and a cleaning unit including the cleaning blade 5 according to any one of aspect A to aspect G to remove toner adhering to the surface of the image carrier. The process cartridge supports the cleaning unit and the image carrier as a single unit, and is detachably attached with respect to a body of an image forming apparatus. The cleaning blade 5 includes the blade member formed of the strip-shaped rubber material and having the leading-edge ridge line portion 61 to contact the surface of the image carrier and remove toner adhering to the surface of the image carrier. The blade member 5 has a Martens hardness of 1.0 N/mm$^2$ or more in the vicinity of the leading-edge ridge line portion 61 measured from the opposing surface 62 of the blade member, the opposing surface 62 including the leading-edge ridge line portion 61 and opposing the image carrier, or measured from the leading-edge surface 63 of the blade member, the leading-edge surface 63 including the leading-edge ridge line portion 61 and disposed adjacent to the opposing surface 62 of the blade member.

Accordingly, as described in the above-described embodiments, the generation of filming on the surface of the drum shaped photoreceptor 10 and the generation of cleaning failure may be favorably suppressed. In addition, by making a configuration of the process cartridge, operability may be enhanced.

What is claimed is:

1. A cleaning blade, comprising:

a blade member formed of a strip-shaped rubber material and having a leading-edge ridge line portion to contact a moving surface of a cleaning target member and remove adhering matter from the surface of the cleaning target member, wherein the blade member has a Martens hardness of 1.0 N/mm$^2$ or more in a vicinity of the leading-edge ridge line portion measured from an opposing surface of the blade member, the opposing surface including the leading-edge ridge line portion and opposing the cleaning target member, or measured from a leading-edge surface of the blade member, the leading-edge surface including the leading-edge ridge line portion and disposed adjacent to the opposing surface of the blade member.

2. The cleaning blade of claim 1, wherein the blade member has a laminated structure including an edge layer including the leading-edge ridge line portion and at least one layer laminated on the edge layer, and a Martens hardness of the edge layer in the vicinity of the leading-edge ridge line portion measured from the opposing surface or the leading-edge surface of the blade member is different from a Martens hardness of a layer other than the edge layer measured from the leading-edge surface of the blade member.

3. The cleaning blade of claim 1, wherein the blade member has a laminated structure including an edge layer including the leading-edge ridge line portion and at least one layer laminated on the edge layer, a Martens hardness of the layer other than the edge layer measured from the leading-edge surface or a back surface of the blade member opposite the opposing surface of the blade member is smaller than a Martens hardness of the edge layer in the vicinity of the leading-edge ridge line portion measured from the opposing surface or the leading-edge surface of the blade member.

4. The cleaning blade of claim 1, wherein the vicinity of the leading-edge ridge line portion, each of the opposing surface and the leading-edge surface includes a first rubber material having a Martens hardness different from a Martens hardness of a second rubber material forming an area other than the vicinity of the leading-edge ridge line portion.

5. The cleaning blade of claim 1, wherein the opposing surface and the leading-edge surface contact the surface of the cleaning target member when the blade member is in contact with the surface of the cleaning target member.

6. The cleaning blade of claim 1, wherein at least a 100% modulus value at 23° C. of a material forming the leading-edge ridge line portion of the blade member is in a range from 6 Mpa to 12 Mpa.

7. The cleaning blade of claim 1, wherein the rubber material forming the blade member has a tan δ peak temperature of less than 10° C.

8. An image forming apparatus comprising:

an image carrier serving as a surface moving member to bear an image on a surface thereof, the image of a low temperature fixing toner having a low glass transition temperature (Tg) and transferred from the image carrier to a recording medium; and a cleaning blade to contact the surface of the image carrier to remove the toner adhering to the surface of the image carrier, the cleaning blade including a blade member formed of a strip-shaped rubber material and having a leading-edge ridge line portion to contact the surface of the image carrier and remove toner adhering to the surface of the image carrier, wherein the blade member has a Martens hardness of 1.0 $N/mm^2$ or more in a vicinity of the leading-edge ridge line portion measured from an opposing surface of the blade member, the opposing surface including the leading-edge ridge line portion and opposing the image carrier, or measured from a leading-edge surface of the blade member, the leading-edge surface including the leading-edge ridge line portion and disposed adjacent to the opposing surface of the blade member.

9. The image forming apparatus of claim 8, wherein the surface of the image carrier includes inorganic fine particles.

10. The image forming apparatus of claim 8, further comprising a protectant coating device to coat a protectant on the surface of the image carrier.

11. The image forming apparatus of claim 8, wherein the toner contains an additive including a fatty acid metal salt.

12. A process cartridge comprising:

an image carrier to bear a toner image on a surface thereof; and a cleaning unit including a cleaning blade to remove toner adhering to the surface of the image carrier, wherein the process cartridge supports the cleaning unit and the image carrier as a single unit, and is detachably attached with respect to a body of an image forming apparatus, wherein the cleaning blade includes a blade member formed of a strip-shaped rubber material and having a leading-edge ridge line portion to contact the surface of the image carrier and remove toner adhering to the surface of the image carrier, and wherein the blade member has a Martens hardness of 1.0 $N/mm^2$ or more in a vicinity of the leading-edge ridge line portion measured from an opposing surface of the blade member, the opposing surface including the leading-edge ridge line portion and opposing the image carrier, or measured from a leading-edge surface of the blade member, the leading-edge surface including the leading-edge ridge line portion and disposed adjacent to the opposing surface of the blade member.

* * * * *